US006983785B2

(12) United States Patent
Altimore

(10) Patent No.: US 6,983,785 B2
(45) Date of Patent: Jan. 10, 2006

(54) DOOR OPERATING MECHANISM AND METHOD OF USING THE SAME

(76) Inventor: Larry J. Altimore, 1423 Saratoga Ave., SW., Canton, OH (US) 44710

( * ) Notice: Subject to any disclaimer, the term of this patent is extended or adjusted under 35 U.S.C. 154(b) by 37 days.

(21) Appl. No.: 10/689,281

(22) Filed: Oct. 20, 2003

(65) Prior Publication Data

US 2005/0082015 A1 Apr. 21, 2005

(51) Int. Cl.
*E05F 11/54* (2006.01)

(52) U.S. Cl. ..... 160/191; 49/200; 16/72

(58) Field of Classification Search ..... 160/188, 160/189, 190, 191, 193; 49/199, 200
See application file for complete search history.

(56) References Cited

U.S. PATENT DOCUMENTS

| | | | | | |
|---|---|---|---|---|---|
| 1,530,762 | A | * | 3/1925 | Dautrick | 160/191 |
| 1,897,391 | A | * | 2/1933 | Kelly | 160/189 |
| 2,059,585 | A | * | 11/1936 | Kelly | 160/209 |
| 2,330,006 | A | * | 9/1943 | Odenthal | 60/465 |
| 2,533,423 | A | * | 12/1950 | Bunch | 49/200 |
| 2,534,525 | A | * | 12/1950 | Molloy | 91/52 |
| 3,165,143 | A | * | 1/1965 | Jackwig | 160/189 |
| 3,240,484 | A | * | 3/1966 | Klamp | 160/189 |
| 3,349,516 | A | * | 10/1967 | Armstrong | 49/25 |
| 3,468,060 | A | | 9/1969 | Mursinna | |
| 3,537,503 | A | | 11/1970 | Simmonds | |
| 4,102,382 | A | | 7/1978 | Vesbach | |
| 4,417,418 | A | * | 11/1983 | Warning | 49/199 |
| 4,683,677 | A | * | 8/1987 | Jurgensen | 49/200 |
| 4,891,908 | A | | 1/1990 | Aquilina | |
| 4,941,320 | A | | 7/1990 | Kersten et al. | |
| 5,040,332 | A | | 8/1991 | Aquilina | |
| 6,561,256 | B2 | * | 5/2003 | Mullet | 160/191 |
| 6,735,820 | B1 | | 5/2004 | Teutsch | |
| 2003/0209333 | A1 | | 11/2003 | Olmsted | |

* cited by examiner

*Primary Examiner*—Blair M. Johnson
(74) *Attorney, Agent, or Firm*—McDonald Hopkins Co., LPA; Robert H. Earp, III

(57) ABSTRACT

A mechanism and method for operating a track-mounted door is disclosed. The mechanism includes a pair of side drums that are connected by first cables to the bottom of the door. The side drums are coaxially mounted on a shaft for simultaneous rotation with a pair of cable drums. The cable drums are connected to high pressure gas struts by second cables. Each second cable is carried around a shiv wheel that slides along a guide track as the second cable moves. Each shiv wheel is operatively connected to one of the gas struts. As the shiv wheel moves along the guide track toward the cable drum, the gas strut is charged. As the shiv wheel moves away from the cable drum, the gas strut is discharged. A standard electric motor and screw driven lift-arm is used to initiate the opening and closing of the door. The charged gas strut stores sufficient energy to overcome friction and gravity to assist the electric motor and lift-arm to open the door.

32 Claims, 26 Drawing Sheets

DOOR OPERATING MECHANISM AND METHOD OF USING THE SAME

BACKGROUND OF THE INVENTION

1. Technical Field

This invention generally relates to a door operating mechanism. More particularly, the invention relates to a mechanism for opening and closing doors such as garage doors and warehouse doors. Specifically, the invention relates to a door operating mechanism that includes high pressure gas struts for storing the energy required to open the door.

2. Background Information

A variety of operating mechanisms have been disclosed and used in the past for opening garage and warehouse doors of the type that slide along tracks. A previously proposed mechanism is one in which a screw or chain driven door opener is combined with a torsion spring counterbalance system. In this type of system, the torsion spring is connected to a shaft above the door opening and the spring is turned or twisted in the installation process so as to store a certain amount of energy in the spring. Drums are mounted on either end of the shaft and the drums are connected to a cable or chain that is connected to the bottom of the door. When the drum rotates in response to movements in the door, the shaft is rotated and this causes the torsion spring to be twisted. For example, as the door is closed, the torsion spring is caused to be at least partially turned in a first direction causing energy to be stored in the torsion spring. At this stage, the weight of the door is counterbalanced by the torsion spring. When the door is to be opened, an electric motor is activated. The motor is connected to a screw or chain lifting mechanism connected to the top of the door. When this mechanism is activated, the drum is caused to rotate, which rotates the shaft, which allows the stored energy in the torsion spring to be released. The energy released by the spring is sufficient to overcome the effect of gravity and friction on the door and the door is therefore able to be raised. One of the main problems associated with torsion spring counterbalance systems is that the installation of the springs is dangerous for the installers. The installers need to place the spring under high torque, and if for some reason, they cannot connect the spring immediately or correctly, the spring is liable to break free, rotate in an uncontrolled manner and either injure or kill the installer. A second problem experienced with this type of system is that the spring eventually breaks. The homeowner may not realize that the spring has been broken and may activate the electric door opener. This causes the screw to be activated and it attempts to raise the door, but without the input of energy from the torsion spring, the screw is unable to perform the task adequately. This accidental activation tends to result in the twisting damage to the screw and warp damage to the door. The screw is unable to raise the door and the home or building owner has to either repair the existing door and operating mechanism or replace the entire system.

In view of the problems associated with torsion springs, other operating mechanisms have been proposed in the prior art. Some of these systems have utilized hydraulic or pneumatic cylinders connected to a suitable fluid storage tank to store energy for opening the door. Yet other systems have included combinations of springs and hydraulic and pneumatic systems, or combinations of spreading cables and hydraulic systems. While these prior art devices have performed satisfactorily, they have also had problems such as requiring valuable storage space in the garage or building for placement of fluid storage tanks or other related equipment. Furthermore, if the tubing connecting the pneumatic or hydraulic cylinders to their fluid source leak or otherwise fail, the system becomes inoperable in the same manner as the torsion springs—potentially resulting in dangerous or difficult circumstances where the door drops in an uncontrolled manner or cannot be raised.

There is therefore still a need in the art for a mechanism that is easy to install, that can be retrofitted to existing doors and that operates safely and effectively to open and close horizontal or overhead doors that slide in tracks.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
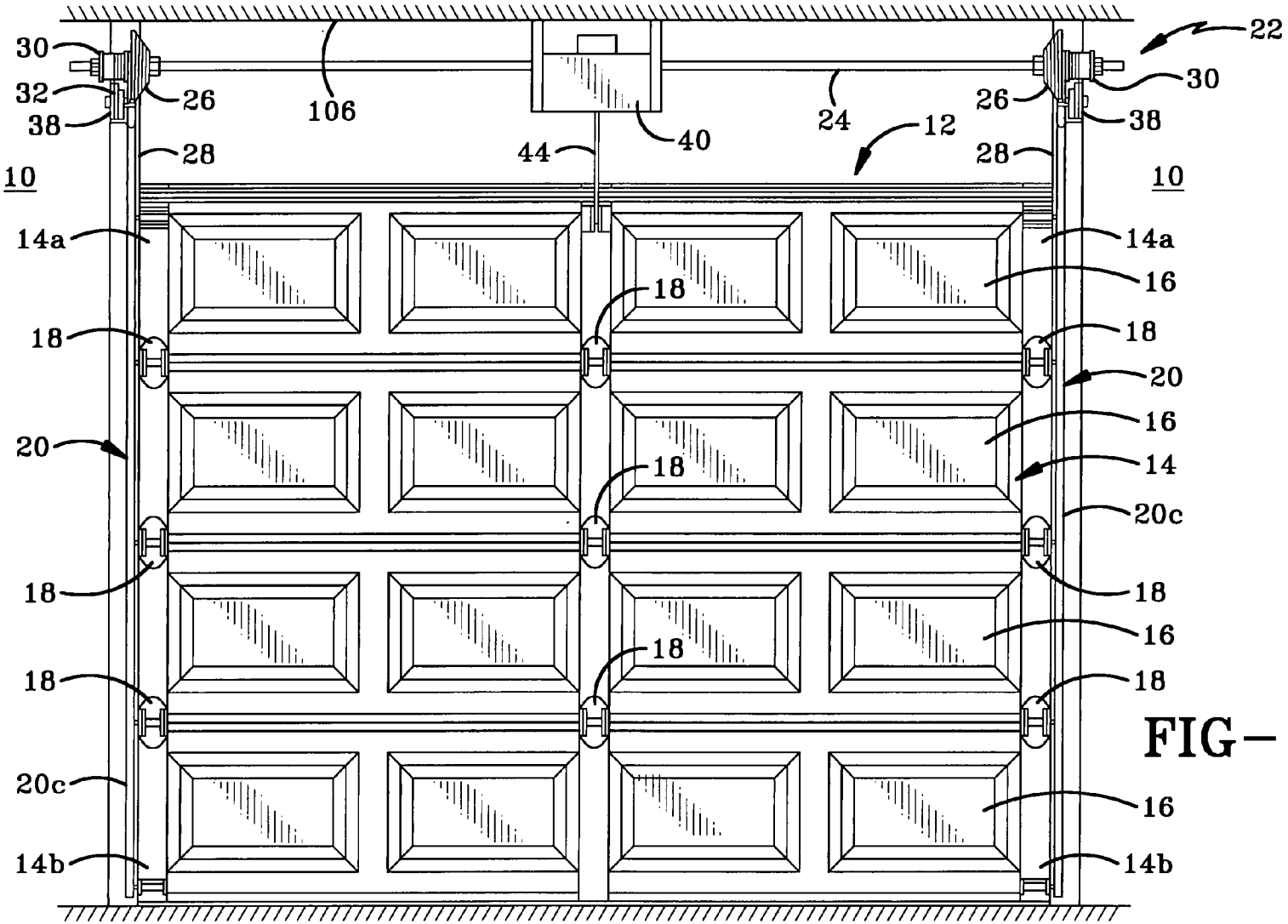
FIG. 1 is a rear view of a garage door and door operating mechanism in accordance with the present invention.
Figure 2:
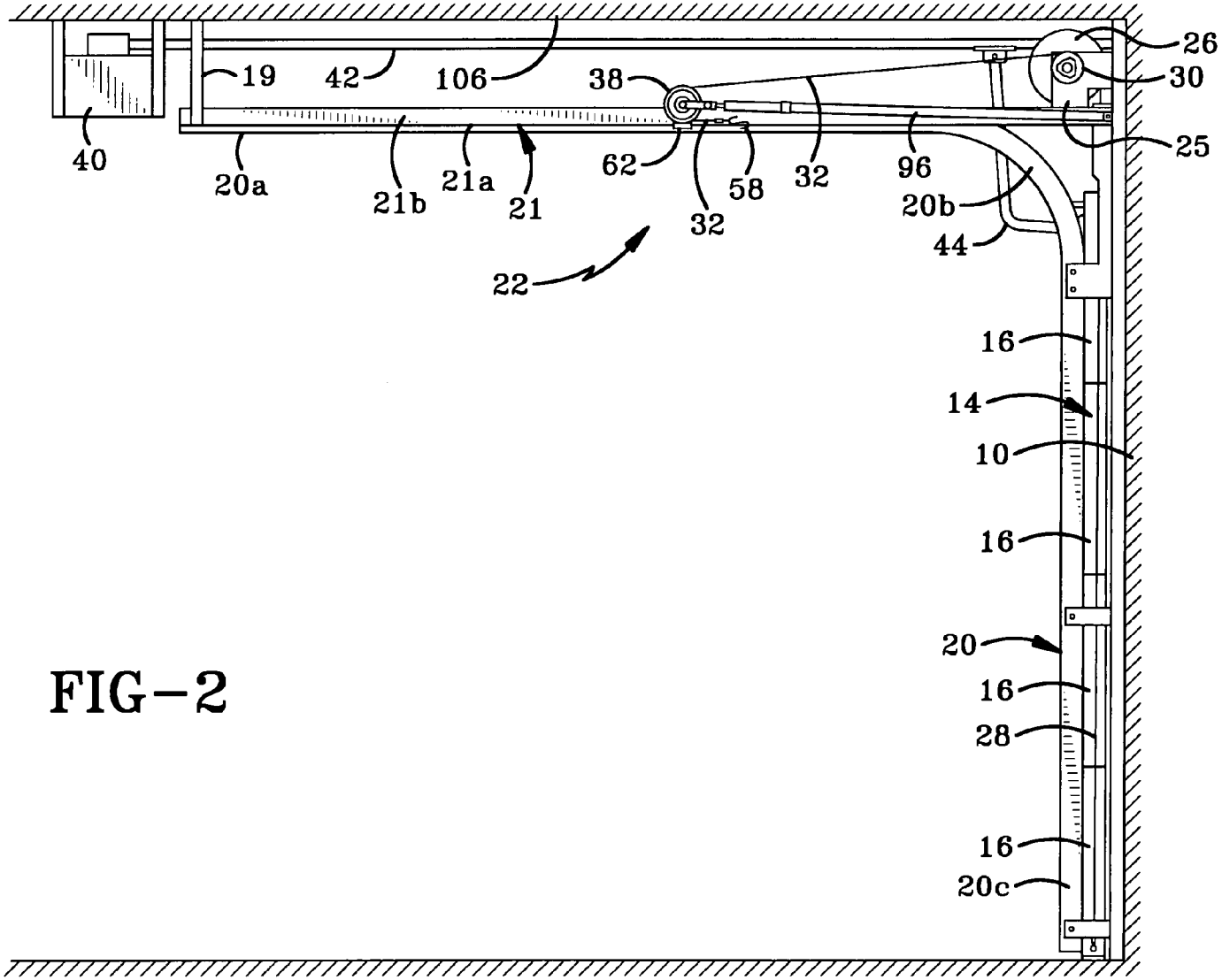
FIG. 2 is a side view of the door operating mechanism.
Figure 3:
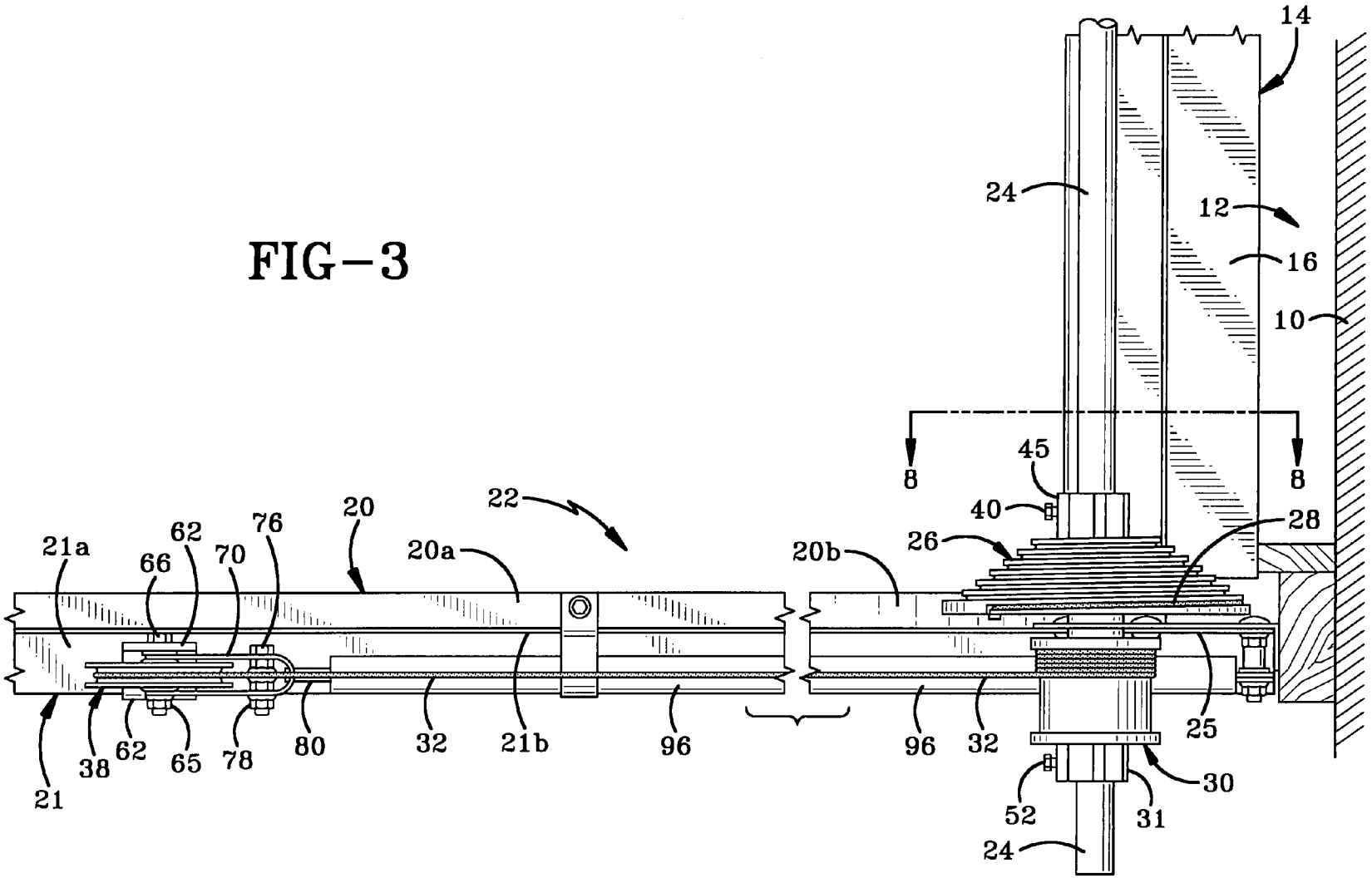
FIG. 3 is a partial top view of the door operating mechanism.
Figure 3A:
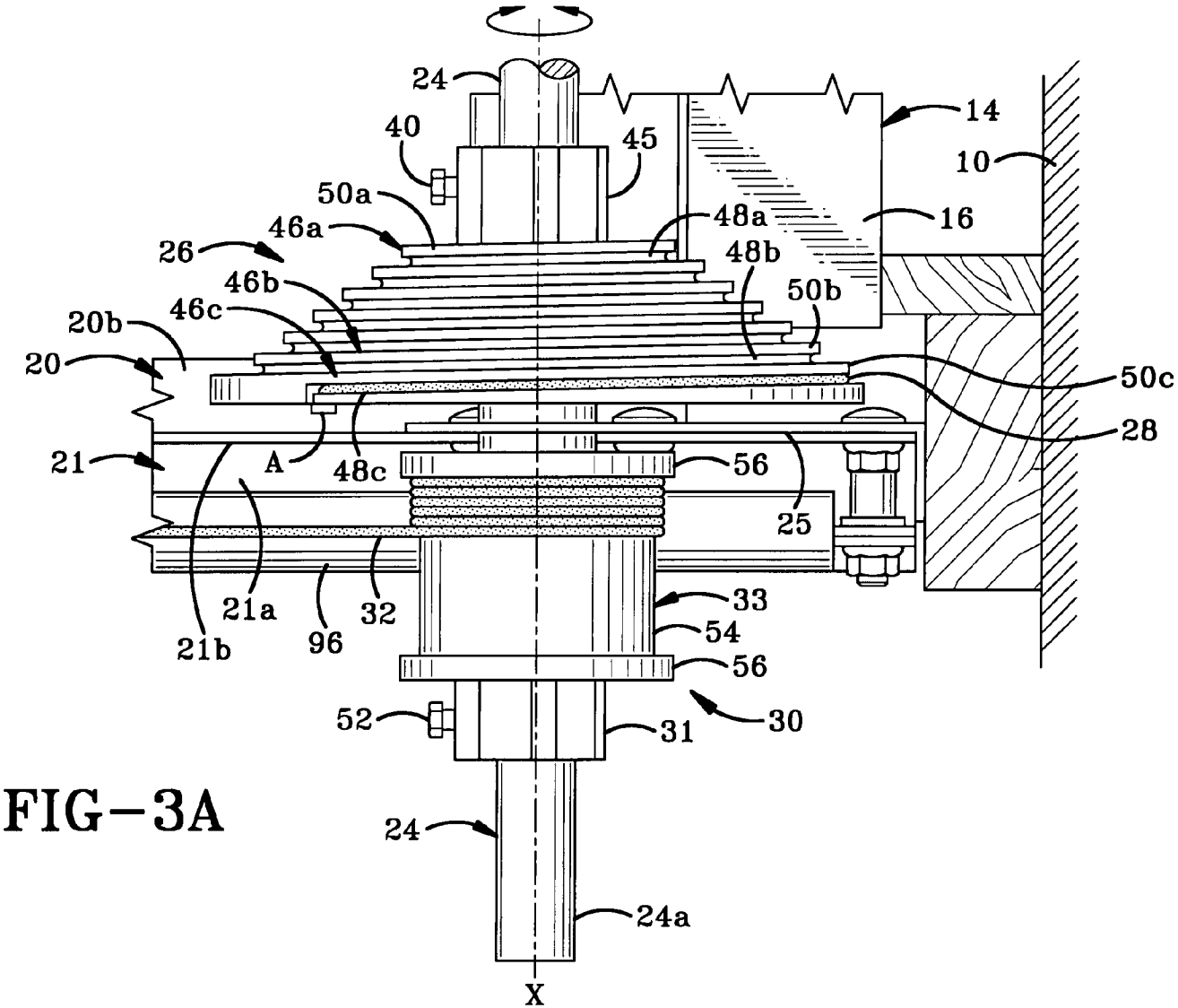
FIG. 3A is a top view of the end of the shaft, the side drum and cable drum of the operating mechanism.

Referring to FIGS. 1 and 2, there is shown a wall 10 having an opening 12 therein and a door 14 adapted to be raised and lowered on a set of spaced apart tracks 20 mounted on wall 10 on either side of opening 12. Door 14 includes a plurality of longitudinal panels 16 that are connected together by hinges 18. Door 14 is raised and lowered by a door operating mechanism in accordance with the present invention and generally referred to by the number 22. Operating mechanism 22 includes a shaft 24 mounted proximate the upper portion of opening. A pair of spaced apart helical or side drums 26 are mounted on shaft 24. While the present embodiment of the invention is shown as operating with a helical drum mounted on shaft 24, it will be understood by those skilled in the art that a non-helical drum may also be used without departing from the spirit of the present invention. A first cable 28 connects each helical or side drum 26 to the bottom 14*b* of door 14. A cable drum 30 is mounted proximate each end of shaft 24 and outside of side drums 26. A bearing plate 25 separates each side drum 26 from the respective cable drum 30. A second gas spring or strut 36 is connected at one end to bearing plate 25 and is linked at the other end to a first gas spring or strut 34 as hereinafter described. First gas strut 34 is connected at its other end to a shiv wheel 38 which rides along a guide track 21. Guide track 21 is mounted substantially parallel to ceiling 106. A second cable 32 connects each cable drum 30 to the linked first and second gas struts 34, 36 via shiv wheel 38. Operating mechanism 22 is used in conjunction with a standard electric door motor 40, screw 42 and lift-arm 44 connected to the upper end 14*a* of door 14. While the present embodiment of the invention is shown as being actuated by motor 40, it will be understood by those skilled in the art that it is not necessary for the door to be powered by a motor in order to operate, the door can be manually raised or lowered or may be raised and lowered by any other suitable mechanism. When electric motor 40 is actuated so that door 14 is closed, each second cable 32 is wrapped around the associated cable drum 30 thereby drawing shiv wheel 38 toward wall 10. The movement of shiv wheel 38 causes movement of the pistons of the first and second gas struts 34, 36. This pressurizes first and second gas struts 34, 36, storing up energy to be utilized when electric motor 40 is actuated to open door 14. When the door 14 is opened, shiv wheel 38 moves away from wall 10 thereby allowing the pressure in first and second gas struts 34, 36 to be discharged or released. This provides the energy needed to overcome gravity and friction and the door 14 is raised.

Referring to FIGS. 3 through 8, the details of one side of the door operating mechanism 22 will be described, but it will be understood by those skilled in the art, that the other side of mechanism 22 is structurally and functionally substantially the same. Shaft 24 is mounted on bearing plates 25 and side drum 26 and cable drum 30 are mounted on shaft 24. Side drum 26 includes a bore (not shown) through which shaft 24 is inserted. Side drum 26 has two sections. The first section is a cylindrical stem 45 and the second section includes a plurality of concentric graduations 46*a*, 46*b*, 46*c* of progressively increasing diameter. Stem 45 and second section with graduations 46*a*, 46*b*, 46*c* are preferably integrally formed. Side drum 26 may be installed on shaft 24 so that the second section is disposed proximate bearing plate 25. Side drum 26 is secured onto shaft 24 by any suitable mechanism such as threaded bolts 40. This allows side drum 26 to rotate with shaft 24. Drum 26 may be manufactured from steel or aluminum or any other suitable material. Each graduation 46*a*, 46*b*, 46*c* includes a respective groove 48*a*, 48*b*, 48*c* and a respective lip 50*a*, 50*b*, 50*c*. First cable 28 may be secured to the graduation 42*c* of greatest diameter by welding cable 28 or bolting it to drum 26. First cable 28 is wound into groove 48*c* of graduation 42*c* and is substantially prevented from slipping out of groove 48*c* by lip 50*c*. As side drum 26 continues to rotate with shaft 24 around the axis of rotation X, first cable 28 is wound into groove 48*b* of graduation 46*b*. First cable 28 continues to be wound into successive grooves of side drum 26 until it is wound into groove 48*a* of graduation 46*a*. As shaft 24 rotates, first cable 28 is wound onto and off of side drum 26. In the case of a side drum 26 for use in conjunction with a standard garage door, drum 26 is adapted to hold at least 7 feet of cable.

Referring still to FIGS. 3 to 8, cable drum 30 is installed and secured proximate each free end 24*a* of shaft 24 on the opposite side of bearing plate 25 to side drum 26. Cable drum 30 includes two sections, a stem 31 and a cable receiving area 33. Drum 30 includes a bore (not shown) through which shaft 24 is inserted. Drum 30 may be secured to shaft 24 by any suitable means such as threaded bolts 52 that are screwed inwardly until they engage and lock cable drum 30 onto shaft 24. When shaft 24 rotates, cable drum 30 rotates. Cable drum 30 may be manufactured from aluminum or steel or any other suitable material and is preferably approximately 3 inches in diameter. Cable receiving section 33 includes a grooved area 54 and a raised edge 56. A first end (not shown) of second cable 32 is secured to cable drum 30. As cable drum 30 rotates with shaft 24, second cable 32 is wound onto and off of cable receiving area 33.

The second end 32*b* of second cable 32 is wound partially around shiv wheel 38 and is secured to a guide track 21 by a suitable mechanism such as a hook 58. Guide track 21 is secured to wall 10 at one end and to a hanger 19 (FIG. 2) at the other end. Guide track 21 may be connected to the horizontal section 20*a* of track 20 and is substantially L-shaped, including a horizontal section 21*a* and a vertical section 20*b*. A bracket 62 is mounted on horizontal section 21*a* of guide track 21 and is adapted to slide along horizontal section 21*a* in response to movements of shiv wheel 38. Bracket 62 includes a vertical slot 68 for mounting of shiv wheel 38. It has been found, in the case of garage doors, that a shiv wheel of approximately 4 inches in diameter is suitable for use in combination with a cable drum of 3 inches in diameter. Shiv wheel 38 includes a central aperture 64 that is selectively alignable with vertical slot 68. Vertical slot 68 is longer and wider than aperture 64. Washers 67 are placed on either side of vertical slot 68 and a bolt 66 may be inserted through vertical slot 68 and aperture 64. A nut 65 is used to lock bolt 66 in place. An U-shaped bracket 70 is used to connect shiv wheel 38 to first gas strut 34. U-shaped bracket 70 includes an aperture 72 through which bolt 66 may be inserted when it is being passed through slot 68 and aperture 64. Shiv wheel 38 also includes a circumferential groove 74 in which second cable 32 is held.

Figure 4:
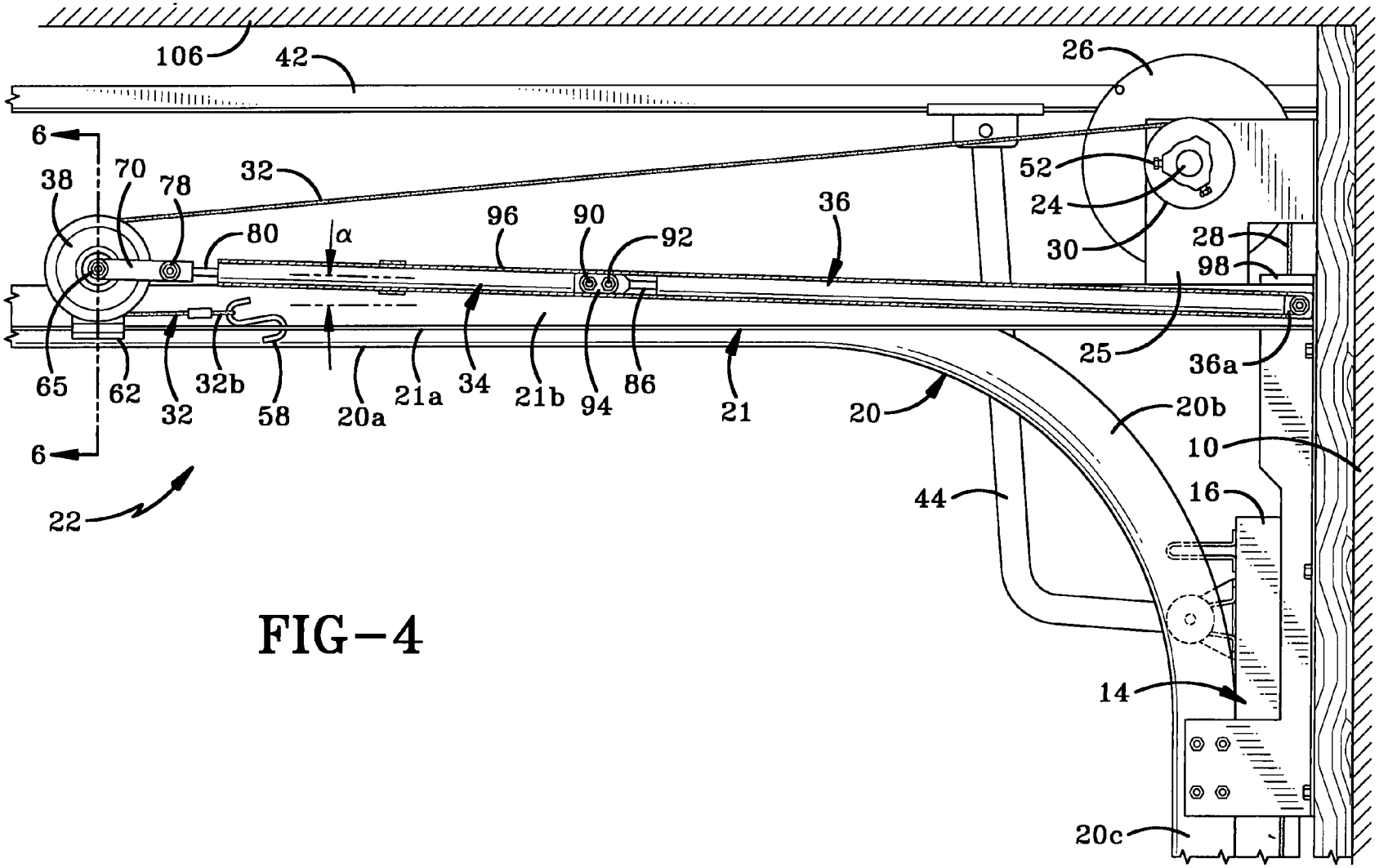
FIG. 4 is an enlarged side view of the operating mechanism showing the inclination of the gas struts.
Figure 5:
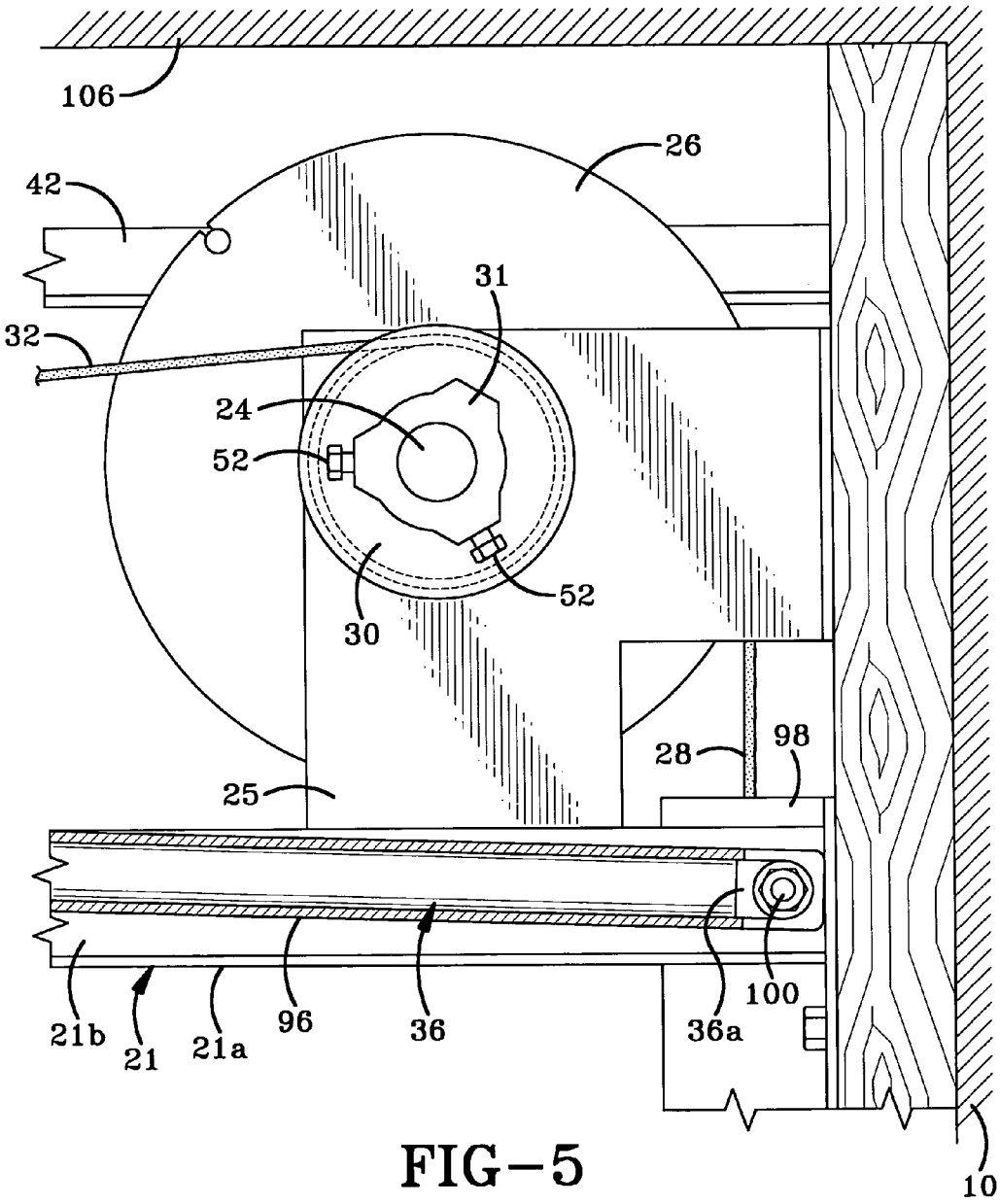
FIG. 5 is an enlarged side view of the end of the shaft.
Figure 6:
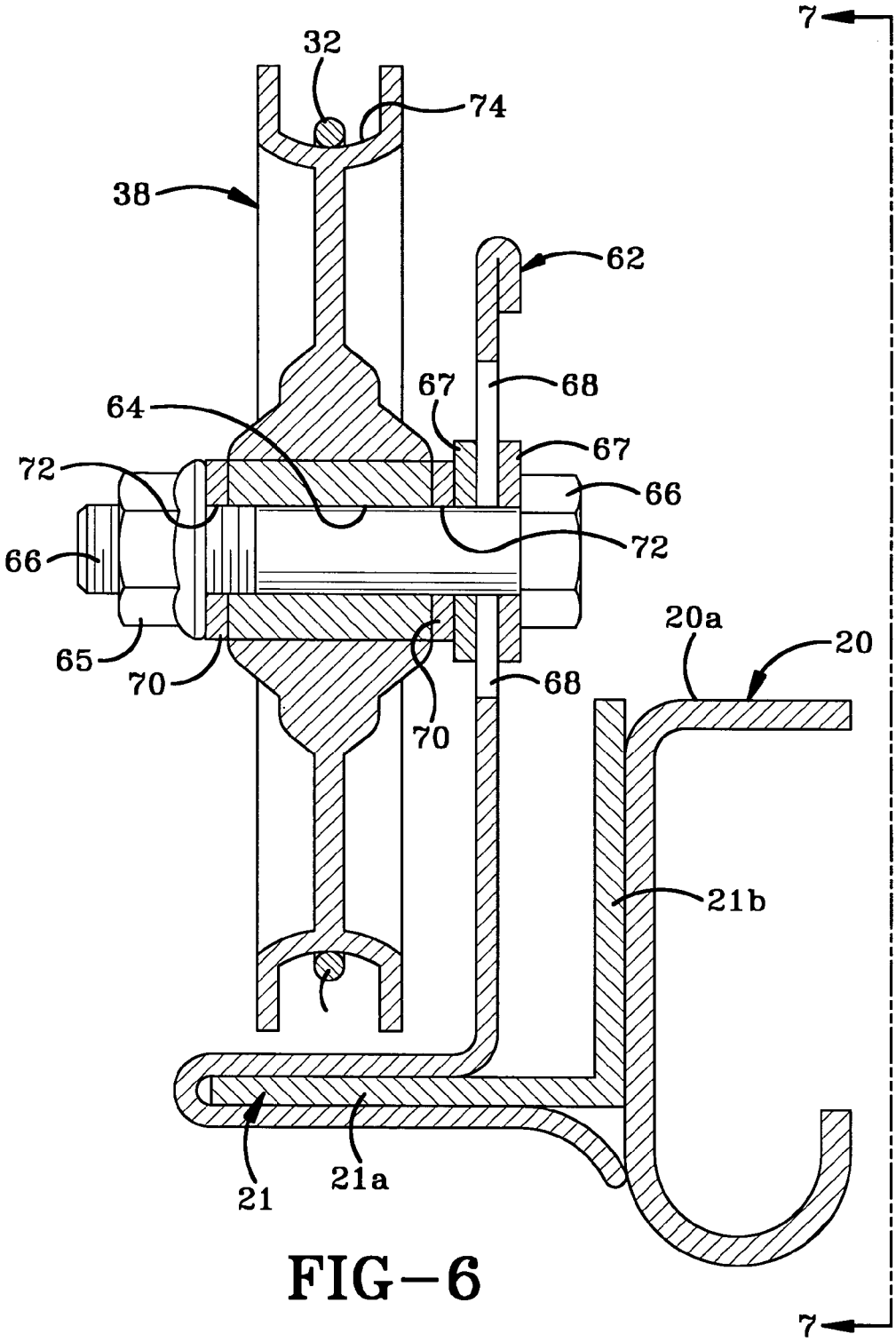
FIG. 6 is a cross-sectional rearview of the first shiv wheel through line 6—6 of FIG. 5.
Figure 7:
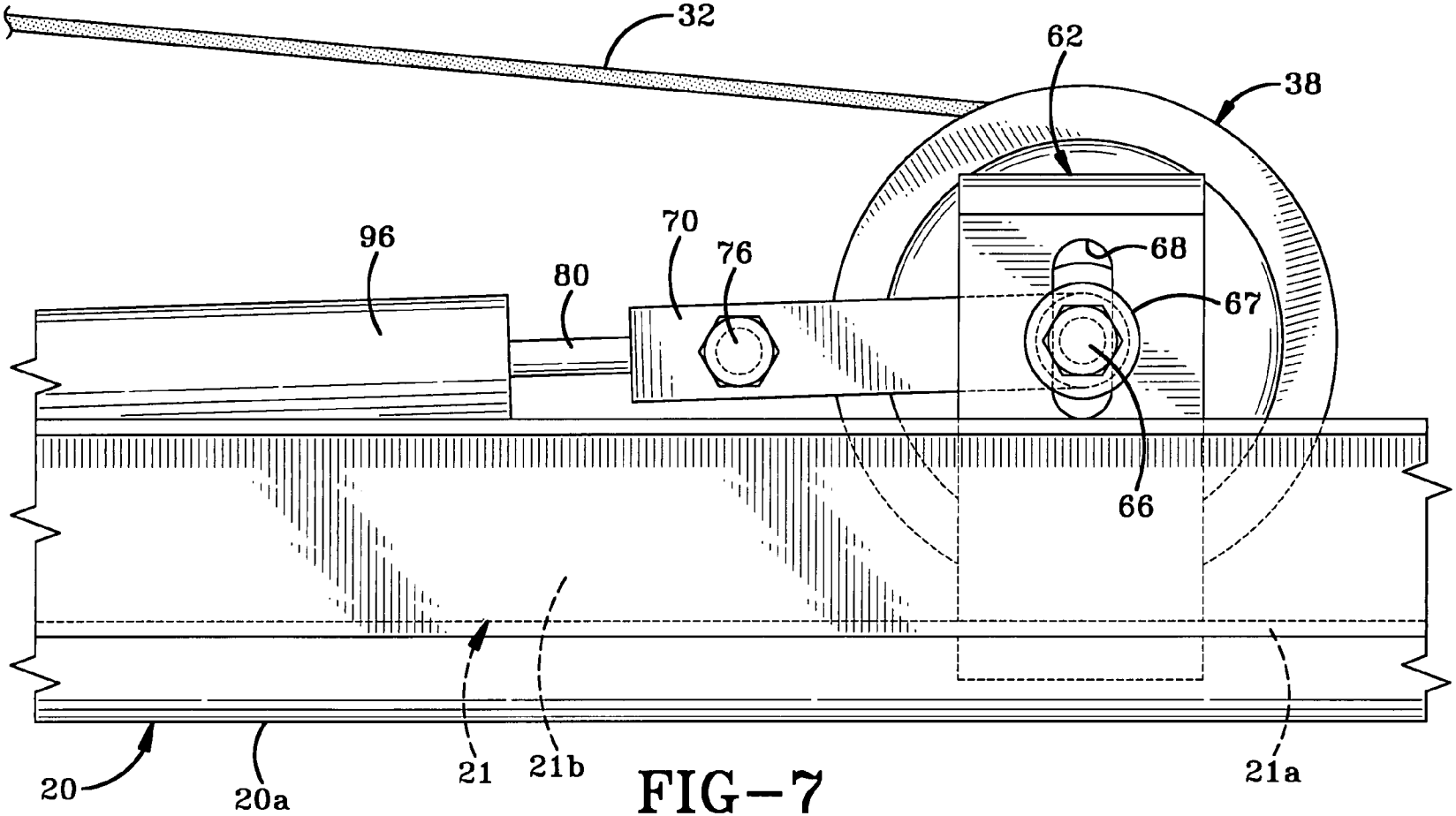
FIG. 7 is a second side view through line 7—7 of FIG. 6.
Figure 8:
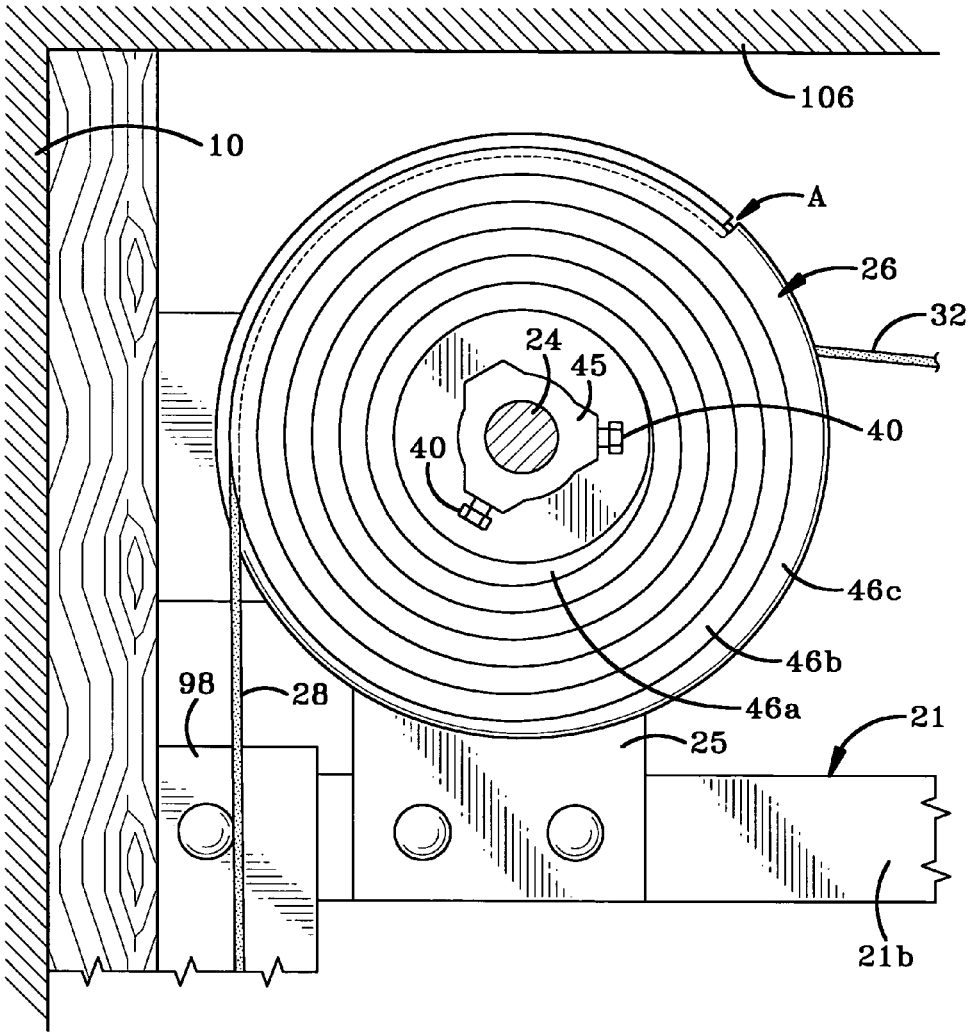
FIG. 8 is a second side view of the side drum.
Figure 9:
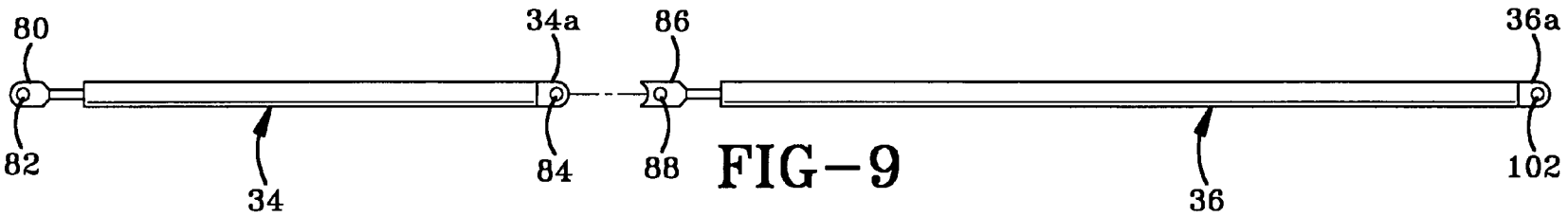
FIG. 9 is an exploded side view of the gas struts of the operating mechanism.
Figure 9A:
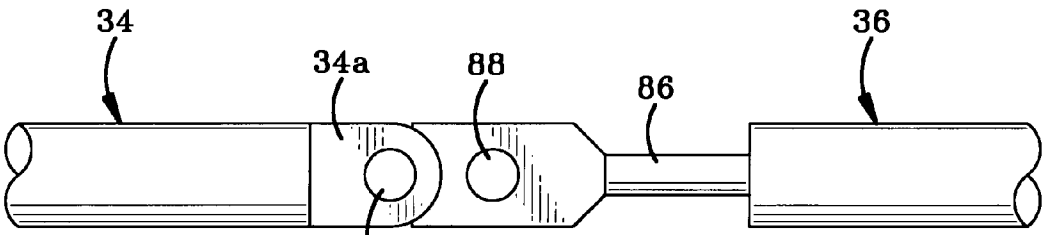
FIG. 9A is a partially exploded and enlarged side view of the end components of the gas struts immediately prior to connection.
Figure 9B:
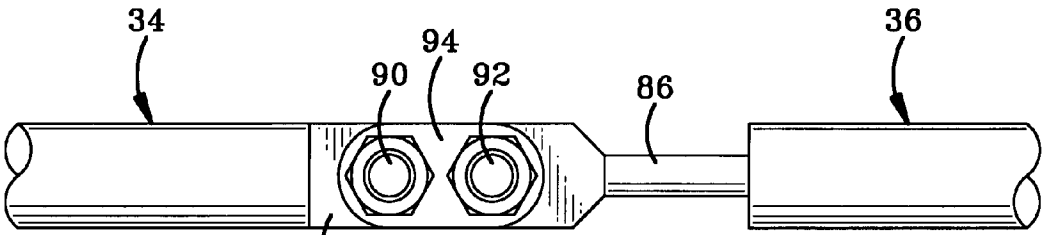
FIG. 9B is an enlarged side view of the end components of the gas struts connected together.
Figure 9C:
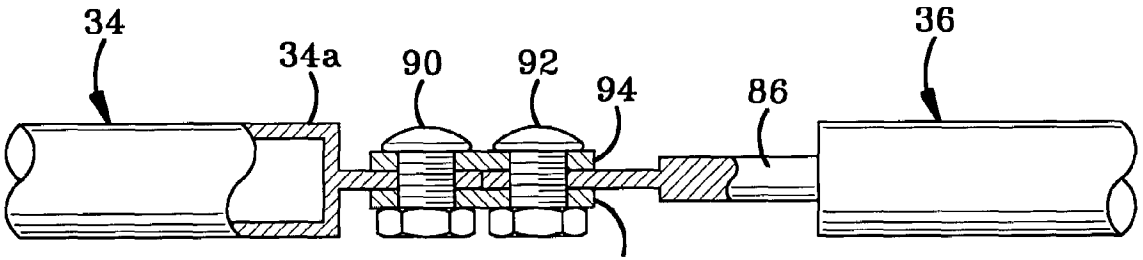
FIG. 9C is an enlarged top view of the end components of the gas struts connected together.
Figure 9D:
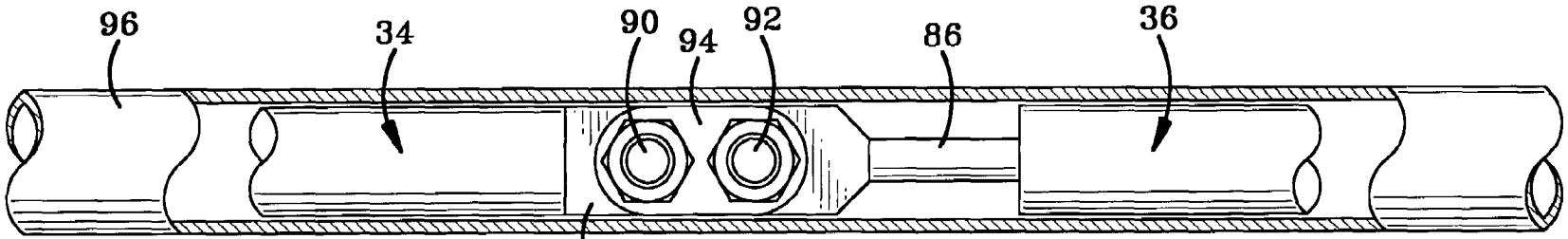
FIG. 9D is a partial cross-sectional side view of the piston rods of the gas struts within the cylinders.
Figure 10:
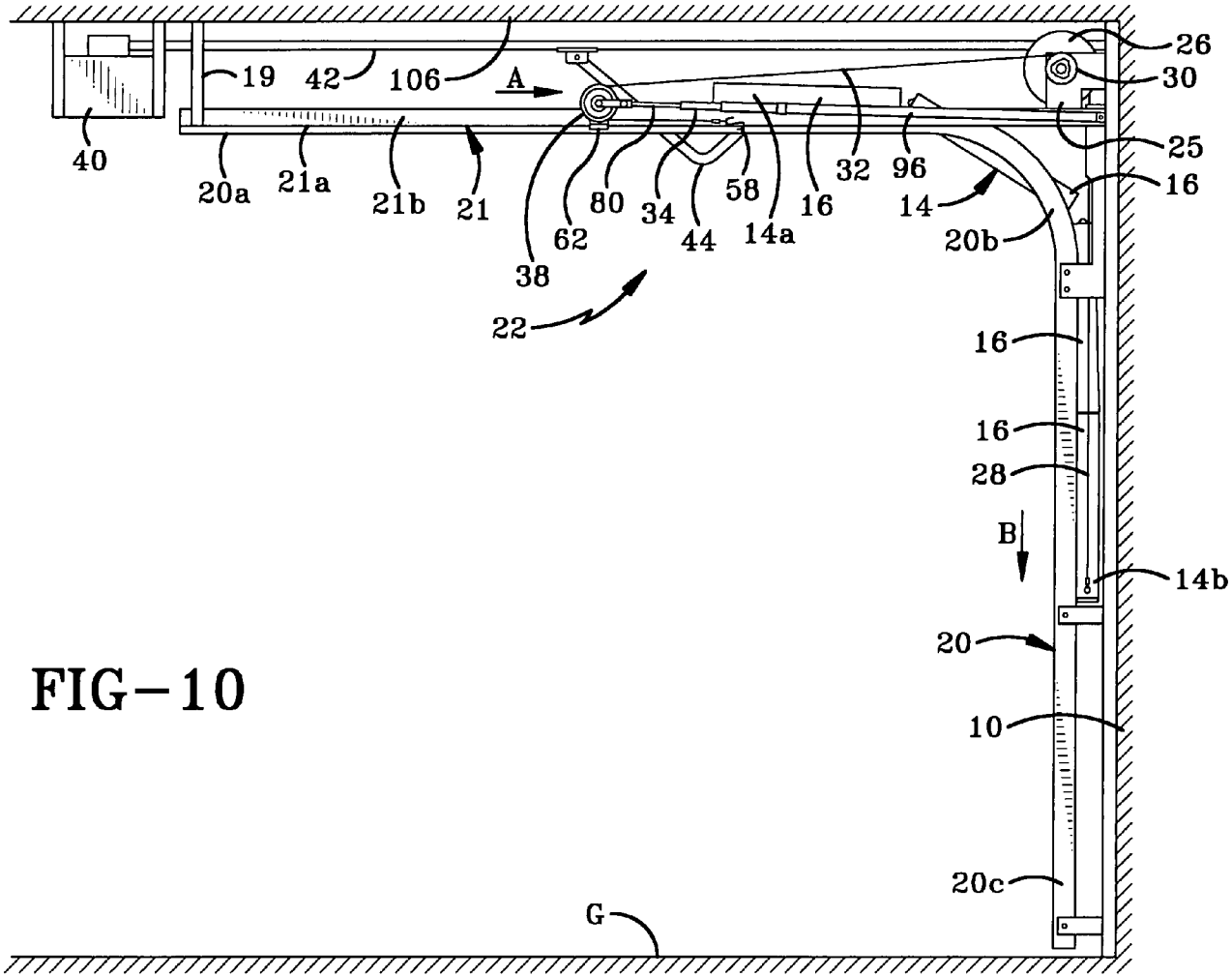
FIG. 10 is a side view of the door and operating mechanism as the door begins to close.
Figure 11:
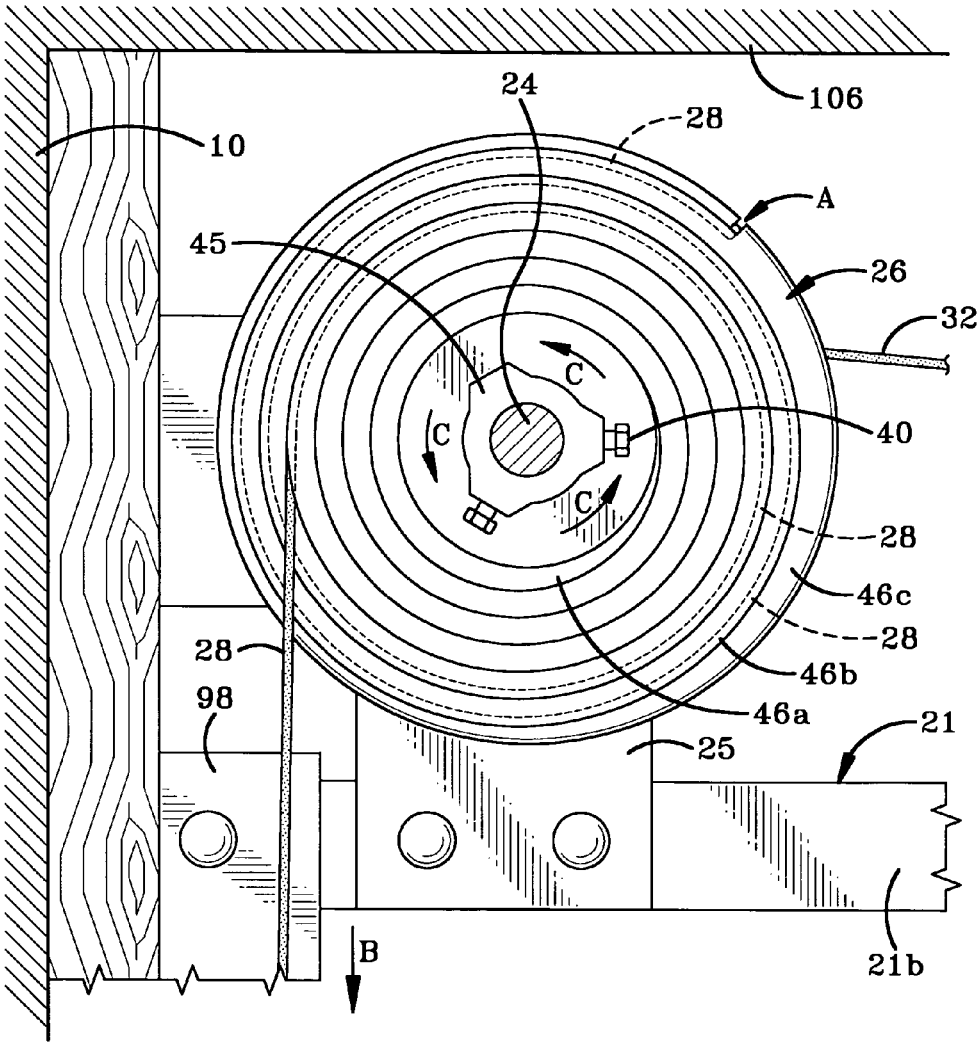
FIG. 11 is an enlarged side view of the operating mechanism as the door begins to close.
Figure 12:
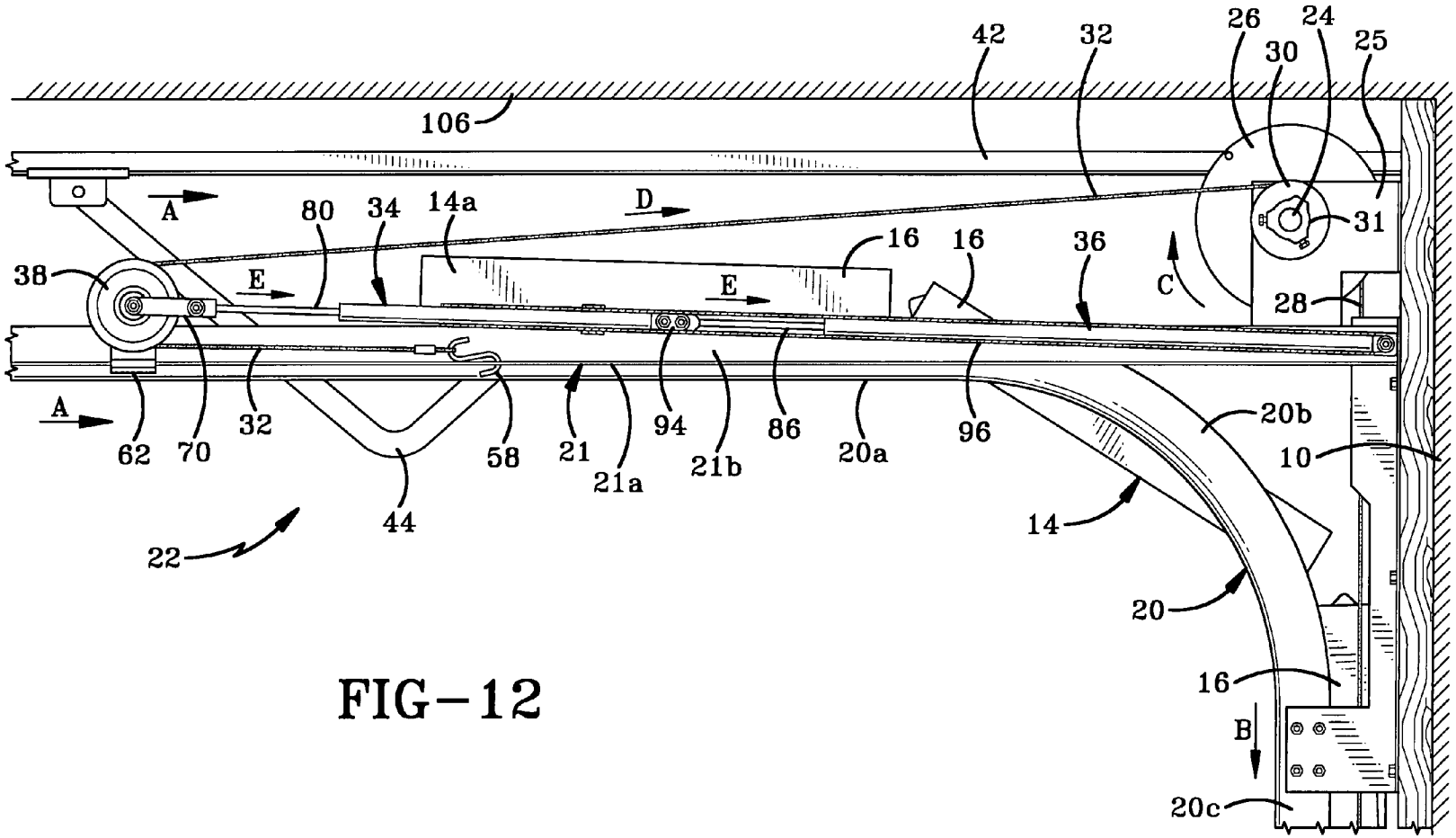
FIG. 12 is an enlarged second side view of the side drum as the door begins to close.
Figure 13:
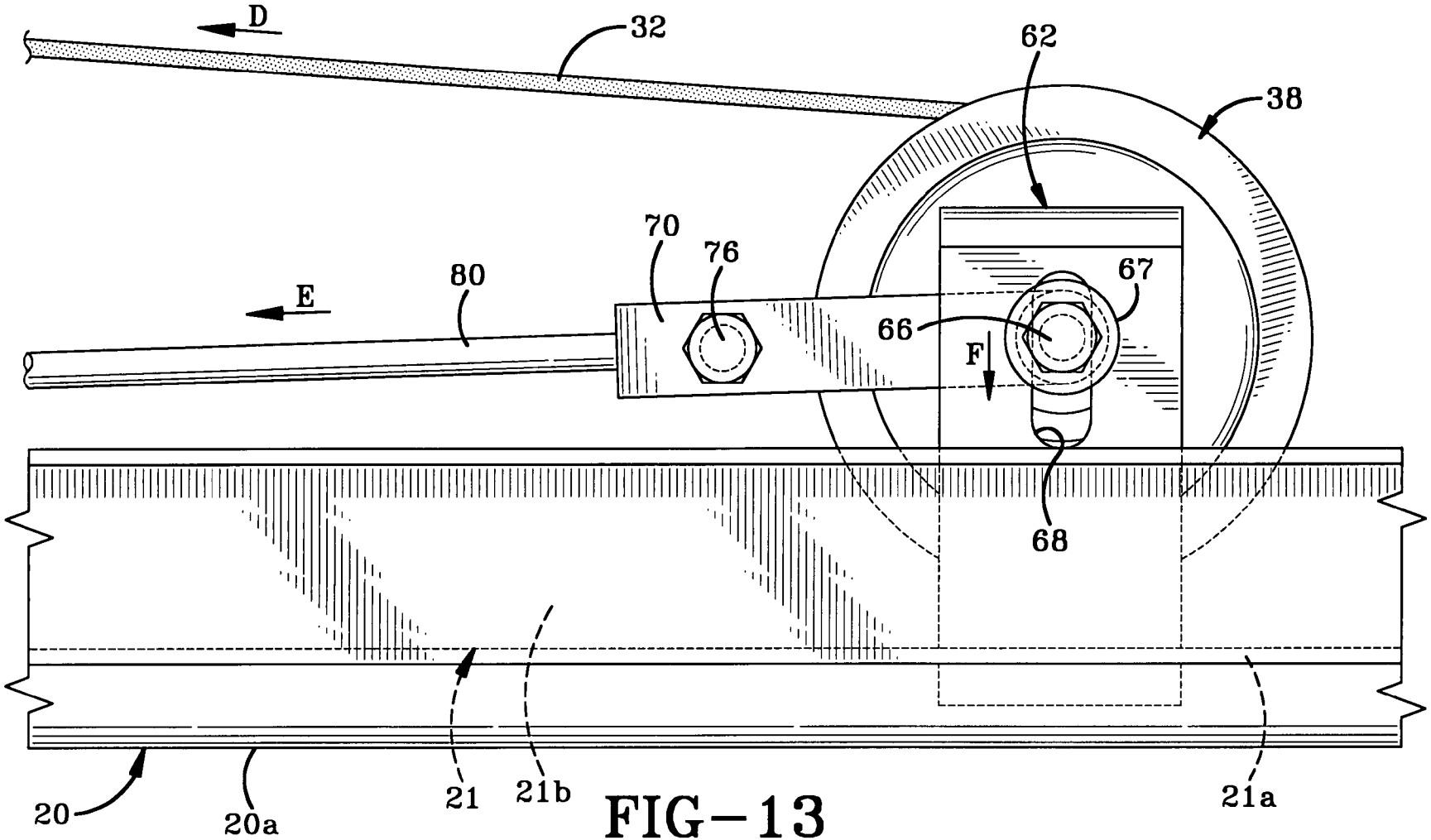
FIG. 13 is an enlarged side view of the shiv wheel as the door begins to close.
Figure 14:
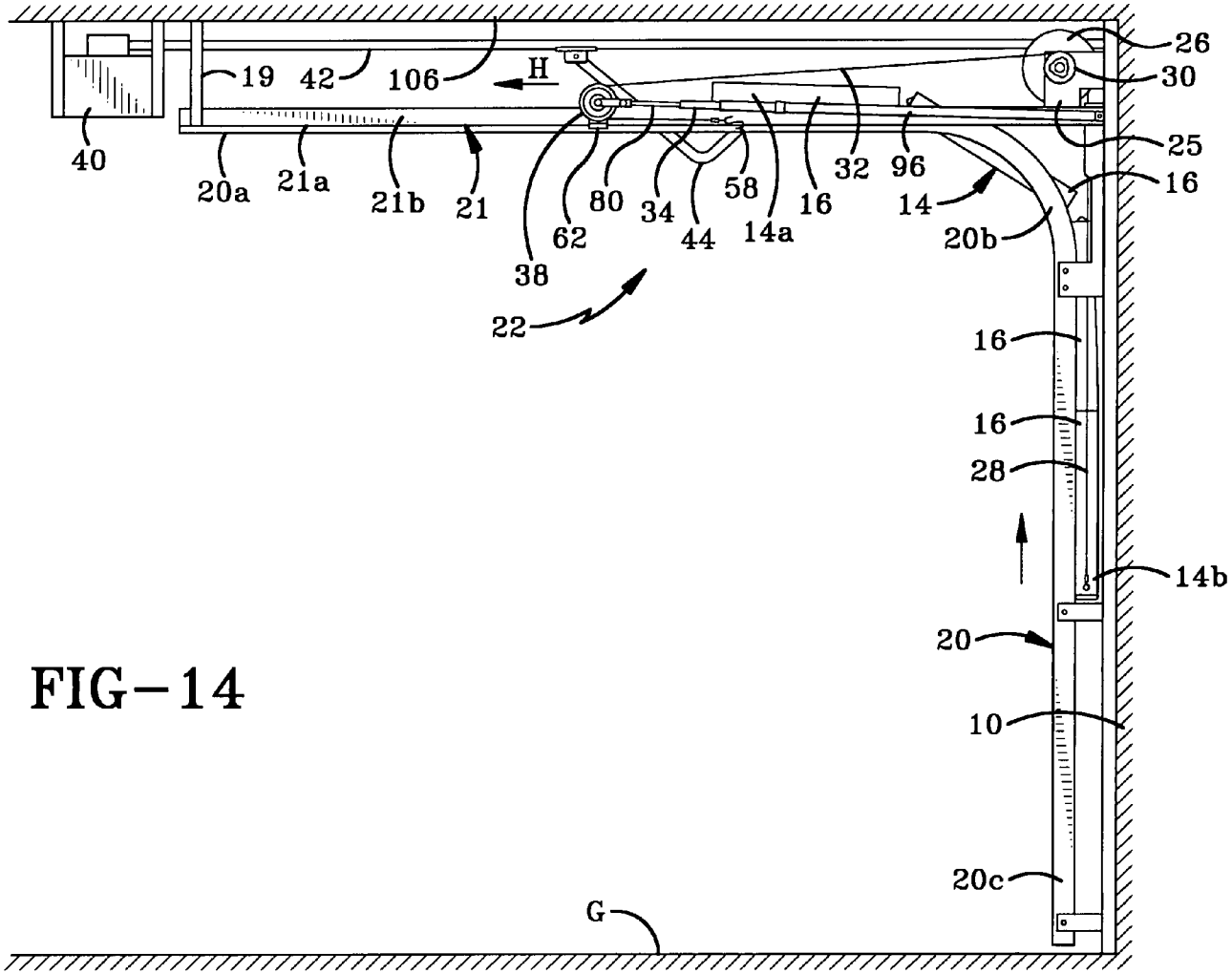
FIG. 14 is a first operational side view showing the door beginning to open.
Figure 15:
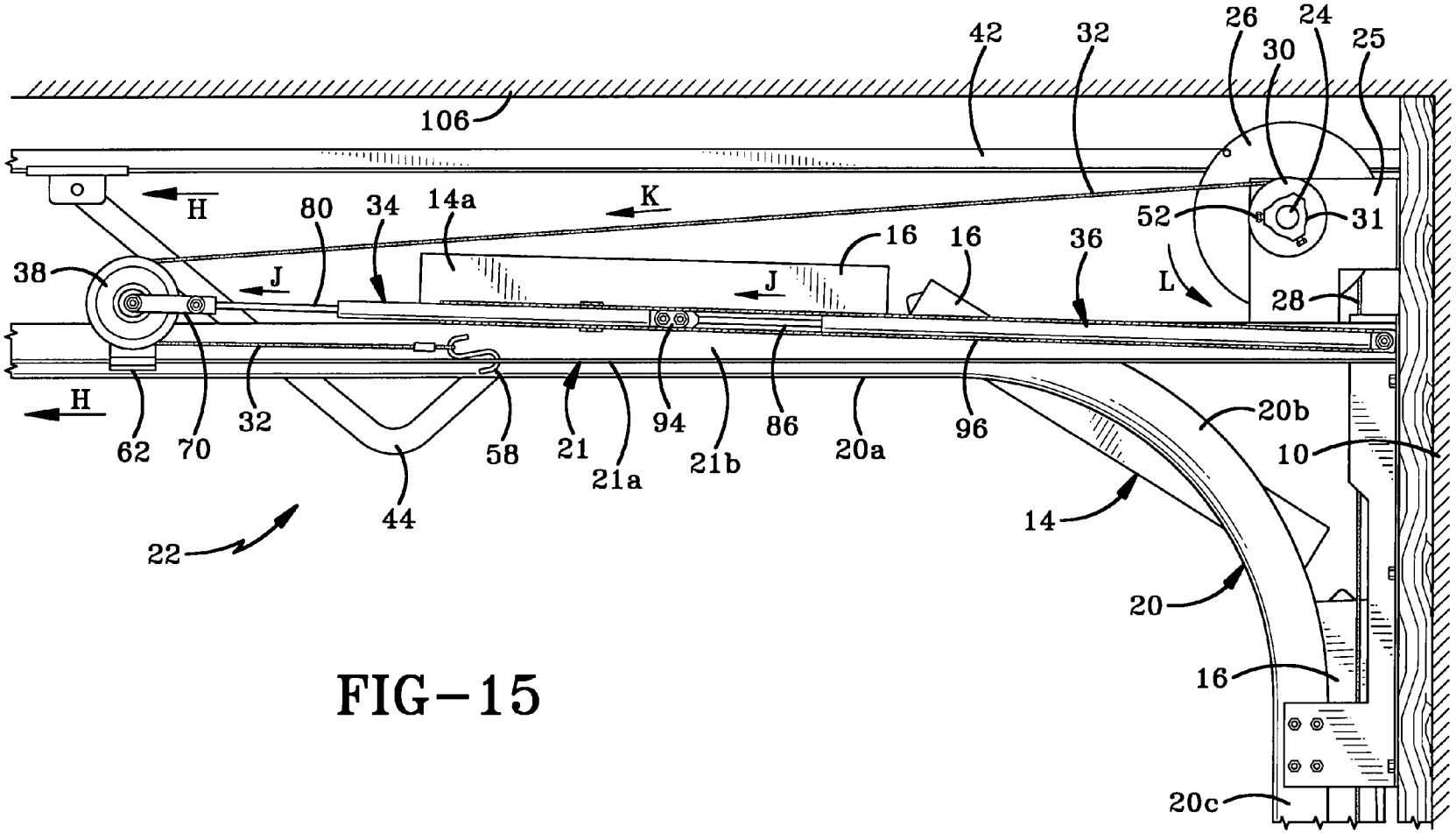
FIG. 15 is an enlarged side view of the operating mechanism as the door begins to open.
Figure 16:
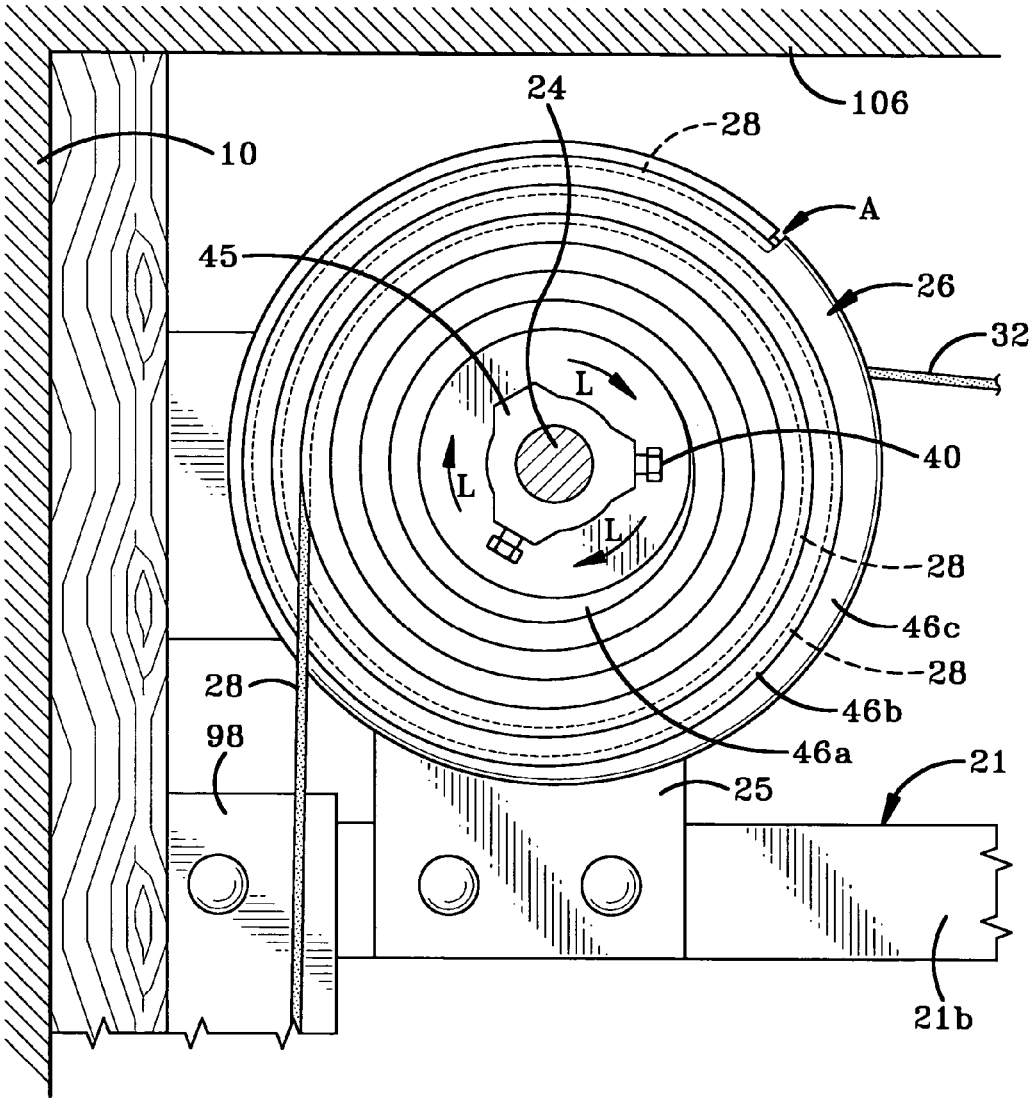
FIG. 16 is an enlarged second side view of the side drum as the door begins to open.

Referring to FIGS. 4 and 9 through 9D, piston rod 80 of first gas strut 34 is connectable to U-bracket 70 by way of a bolt 76 and nut 78. Bolt 76 is inserted through hole 82 in piston rod 80. A second hole 84 is provided in the end 34*a* of first gas strut 34. The piston rod 86 of second gas strut 36 is connected to the end 34*a* of first gas strut 34 by a pair of bolts 90, 92 that are inserted through holes 84 and 88 and connector plates 94. The end 36*a* of second gas strut 36 include a hole 102 through which a bolt 100 is inserted to connect second gas strut 36 to a support bracket 98 that is mounted on wall 10. At least a portion of both first and second gas struts 34, 36 are at least partially constrained within a cylindrical tube 96 as can be best seen in FIG. 9D. As the first and second gas struts 34, 36 are engaged and disengaged, they are able to telescope in and out of tube 96. Tube 96 keeps the first and second gas struts 34, 36 lined up with each other so that they operate in a straight line and so that undue stress is not placed upon connector plates 94 and bolts 90, 92. The linked first gas strut 34 and second gas strut 36 preferably have a combined stroke in the range of between 15 and 30 inches. In the embodiment shown, the linked first gas strut 34 and second gas strut 36 have a combined stroke of 19½ inches. In this embodiment, the first gas strut 34 has a stroke of preferably around 9½ inches and develops about 166 lbs. pressure and the second gas strut 36 preferably has a stroke of around 10 inches and develops about 125 lbs. of pressure. It can be seen from FIG. 5, that the gas struts 34, 36 are mounted at an angle $\alpha$ to the track 20. The piston rod 80 of first gas strut 34 is mounted vertically higher with respect to track 21 than is the end 36*a* of second gas strut 36 because it connects to shiv wheel 38. As the first and second gas struts 34, 36 become charged in response to movement by shiv wheel 38, they will tend to want to move upwardly away from track 21. To compensate for this upward motion, shiv wheel 38 is provided with vertically oriented slot 68. Slot 68 allows for some vertical displacement of bolt 66 in response to movement of shiv wheel 38.

Referring to FIGS. 10–13, when door 14 is to be closed, motor 40 is activated. Motor 40 drives screw 42 which moves lift-arm 44 in the direction of arrow A. As the door 14 is moved downwardly in the direction of arrow B, it slides down the inclined section 20*b* of track 20 and then gravity pulls the bottom 14*b* of door 14 toward the ground G. First cable 28 is connected to the bottom 14*b* of door 14 and, consequently, first cable 28 is pulled downwardly in the direction of arrow B. This causes the first cable 28 to be progressively unwound in the direction of arrow C (FIG. 12) from the grooves 48*a*, 48*b* and 48*c*. As the first cable 28 unwinds, it causes side drum 26 to rotate in the direction of arrow C. As side drum 26 is fixedly connected to shaft 24, when side drum 26 rotates, shaft 24 rotates in the direction of arrow C. This simultaneously causes cable drum 30 to rotate in the same direction. As cable drum 30 rotates, second cable 32 begins to be wound onto cable drum 30. Second cable 32 is drawn toward cable drum 30 in the direction of arrow D. As second cable 32 winds onto cable drum 30, shiv wheel 38 and bracket 32 are moved in the direction of arrow E. Movement in shiv wheel 38 forces piston rod 80 into the cylinder of first gas strut 34 and piston rod 86 into the cylinder of second gas strut 36. First and second gas struts 34, 36 telescope into tube 96. The movement in piston rods 80, 86 causes the pressure within first and second gas struts 34, 36 to rise and the struts become charged. When the door 14 is finally closed all the way to the ground G, the gas struts 34, 36 are fully charged and they store sufficient energy therein to overcome gravity and friction for reopening of door 14. As can best be seen from FIG. 13, the vertical slot 68 in shiv wheel 38 allows the bolt 66 to move slightly downwardly in the direction of arrow F as piston rod 80 is moved into first gas strut 34 in the direction of arrow E. This helps in keeping piston rod 80 correctly aligned with the cylinder in first gas strut 34 and helps reduce stress in piston rod 80 and potential twisting of guide track 21.

Figure 17:
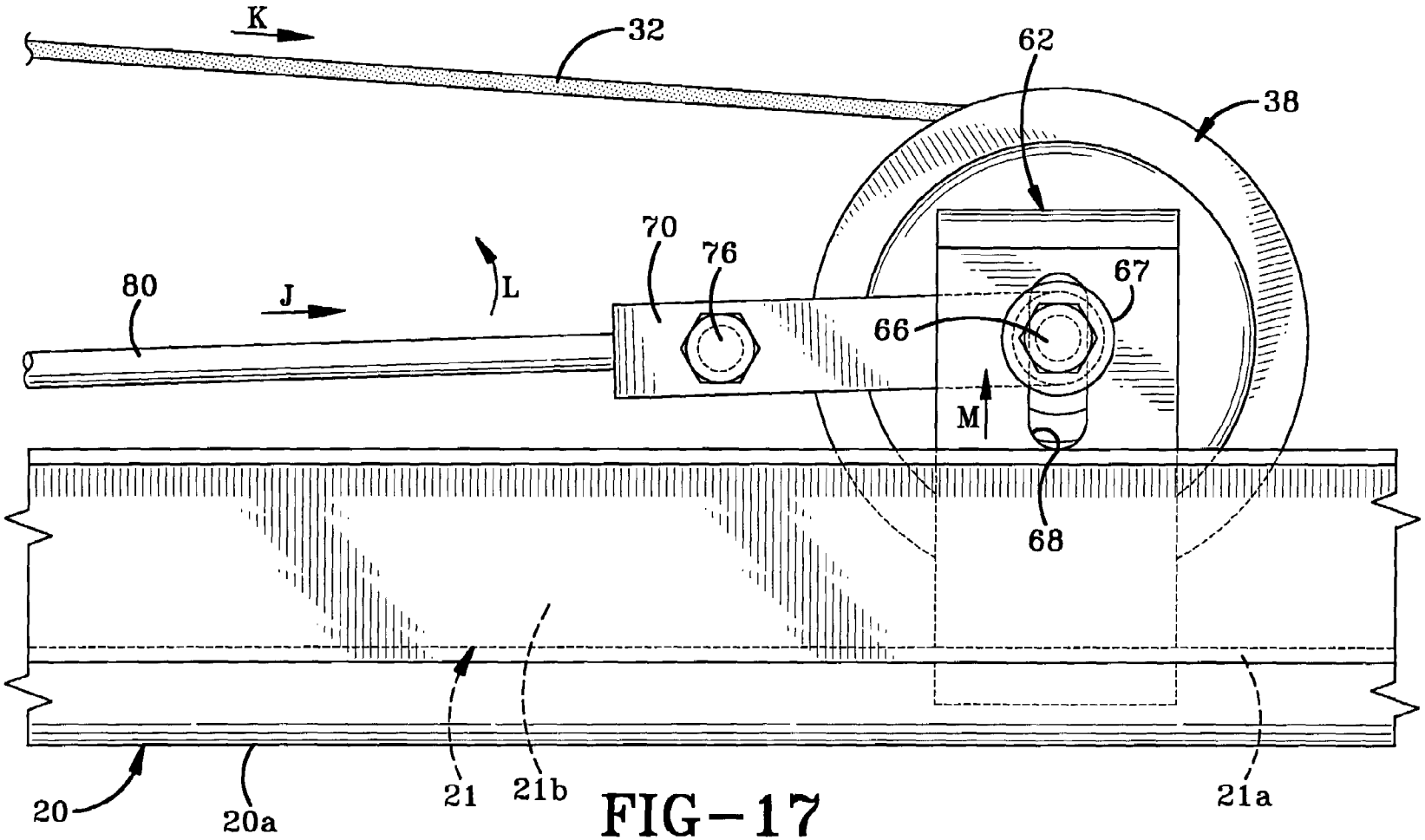
FIG. 17 is an enlarged side view showing the position of the shiv wheel as the door begins to open.
Figure 18:
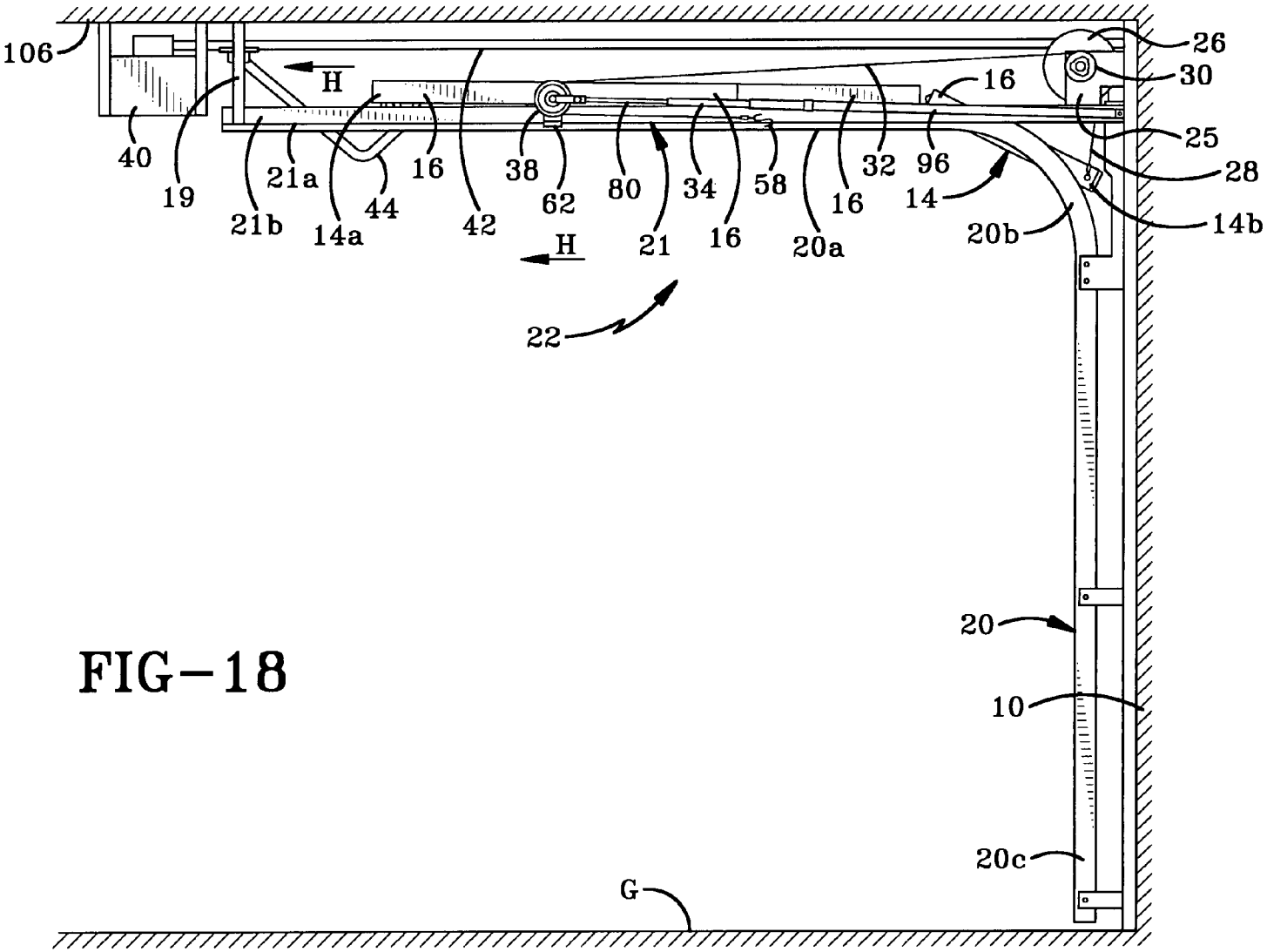
FIG. 18 is a side view of the door and the operating mechanism when the door is almost in the fully open position.
Figure 19:
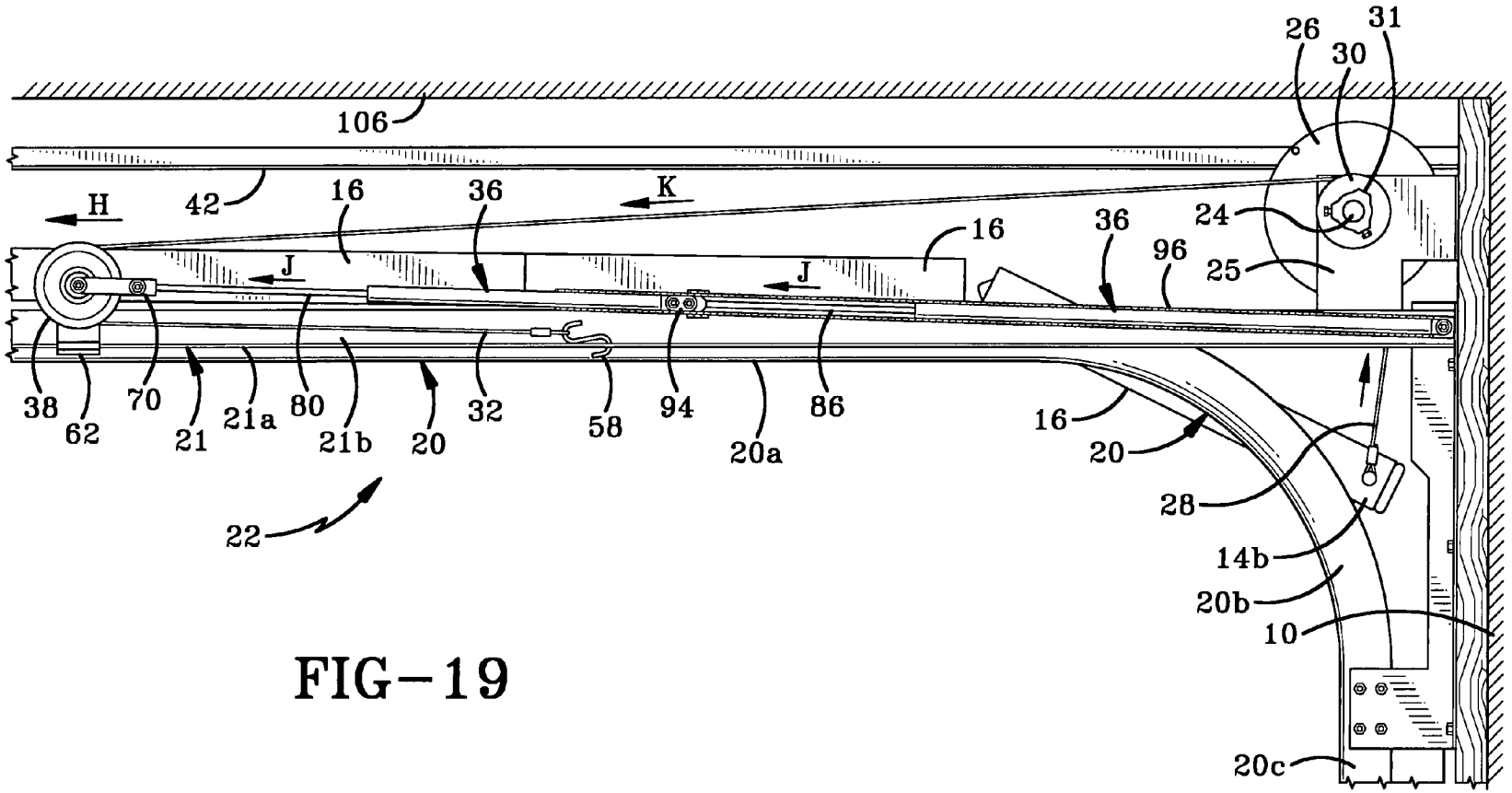
FIG. 19 is an enlarged side view of the operating mechanism when the door is almost in the fully open position.
Figure 20:
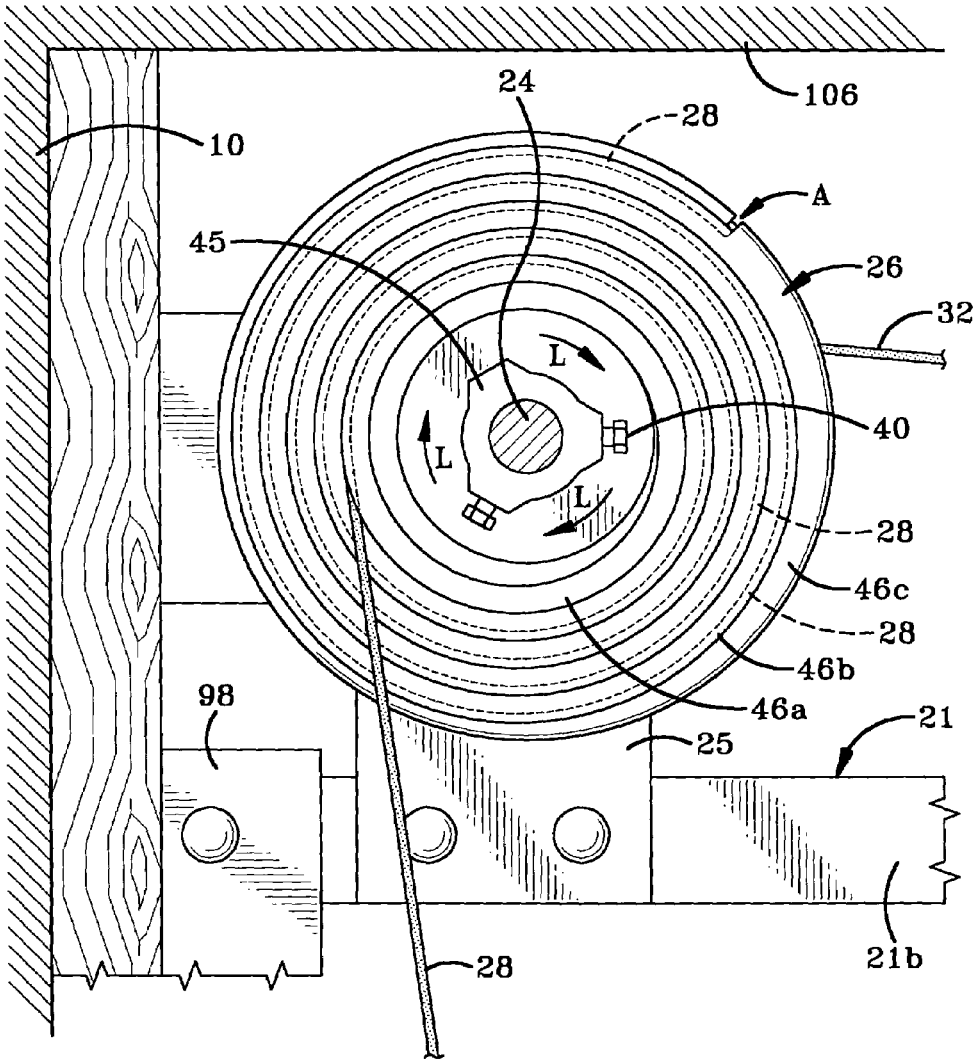
FIG. 20 is an enlarged second side view of the side drum when the door is almost in the fully open position.
Figure 21:
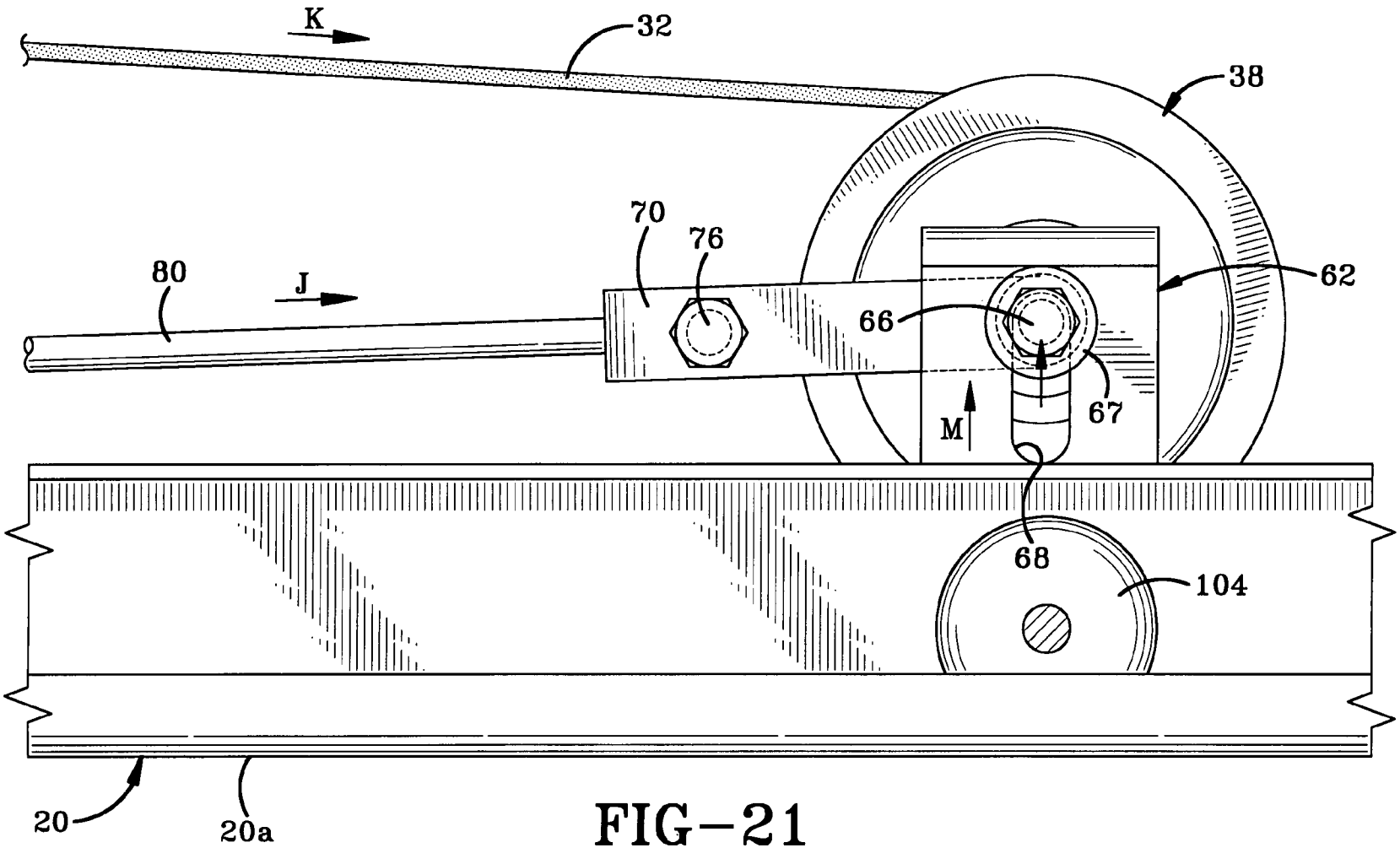
FIG. 21 is an enlarged side view of the shiv wheel when the door is almost in the fully open position.

The opening of door 14 is shown in FIGS. 14 through 21. In order to open door 14, the electric motor 40 is activated. Motor 40 drives screw 42 causing lift-arm 44 to begin to move the upper section 14*a* of door 14 in the direction of arrow H. Panels 16 of door 14 begin to ride up the vertical section 20*c* of tracks 20. The upward movement of the door begins to allow the pressure to slowly discharge or release in first and second gas struts 34, 36. Piston rods 80 and 86 move in the direction of arrow J allowing the first gas strut 34 and then the second gas strut 36 to begin to telescope out of tube 96. This moves shiv wheel 38 in the direction of arrow H which in turn draws second cable 32 off cable drum 30 in the direction of arrow K. The unwinding of second cable 32 from cable drum 30 causes cable drum 30 to rotate in the direction of arrow L. Rotation in cable drum 30 in the direction of arrow L causes shaft 24 to rotate in the same direction. First cable 28 begins to wind onto graduation 46c and continues to progressively wind through graduations 46*b* and 46*a* of side drum 26. Shiv wheel 38 and bracket 62 slide along guide track 21 in the direction of arrow H. As they do so, piston rods 80, 86 and first and second gas struts 34, 36 tend to want to twist upwardly in the direction of arrow L (FIG. 17). In order to reduce this tendency, bolt 66 is able to slide within vertical slot 68 of bracket 62 in the direction of arrow M. Shiv wheel 38 and bracket 62 continue to slide along guide track 21 until door 14 is fully open (FIG. 19). When the door 14 is fully open, first cable 28 is wound onto graduations 46*c*, 46*b* and through to graduation 46*a* of side drum 26. Additionally, the bolt 66 is proximate the upper part of vertical slot 68 as is shown in FIG. 21. (FIG. 21 also shows a runner wheel 104 on which door 14 slides along track 20.) It should be noted that when first cable 28 moves in one direction, second cable 32 moves in the opposite direction, i.e., when first cable 28 is being wound onto side drum 26, second cable 32 is being unwound from cable drum 30 and, similarly, when first cable 28 is being wound off of side drum 26, the second cable 32 is being wound onto cable drum 30.

It will be understood by those skilled in the art that instead of using two linked gas struts 34, 36, it is possible to replace the struts 34, 36 with a single gas strut (not shown) that has a stroke of the same length as the linked struts. In the case of a garage door, the stroke of a single gas strut would have to be around 19½ inches. It is desirable, however, to use the linked struts 34, 36 because of the additional safety of operation that is brought about by the provision of a total of four gas struts on a door 14. One of the major problems with garage doors, as previously outlined, is that when the counterbalance system fails, the door may suddenly drop or may be impossible to open. When four gas struts are used as part of the counterbalance system, the failure of any one strut would not cause the door to drop suddenly or prevent it from being raised.

It will be understood by those skilled in the art, that it is not necessary to utilize a shaft 24 that extends across the entire width of opening 12. It is possible to use two smaller separate shafts (not shown) to operatively connect each side drum 26 with its respective cable drum 30.

Figure 22:
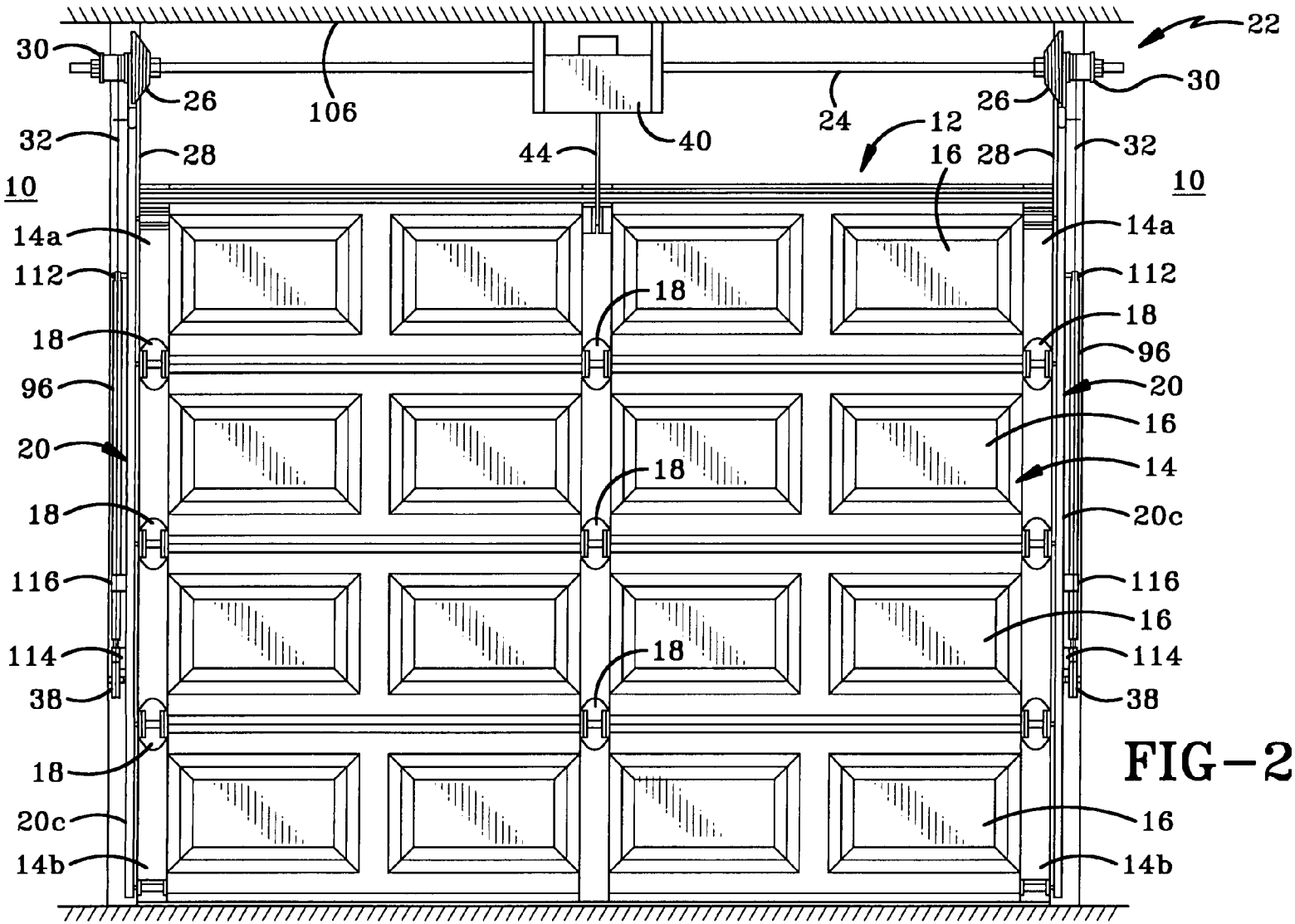
FIG. 22 is a rear view of a garage door and door operating mechanism in which the operating mechanism is mounted adjacent the sides of the door.
Figure 23:
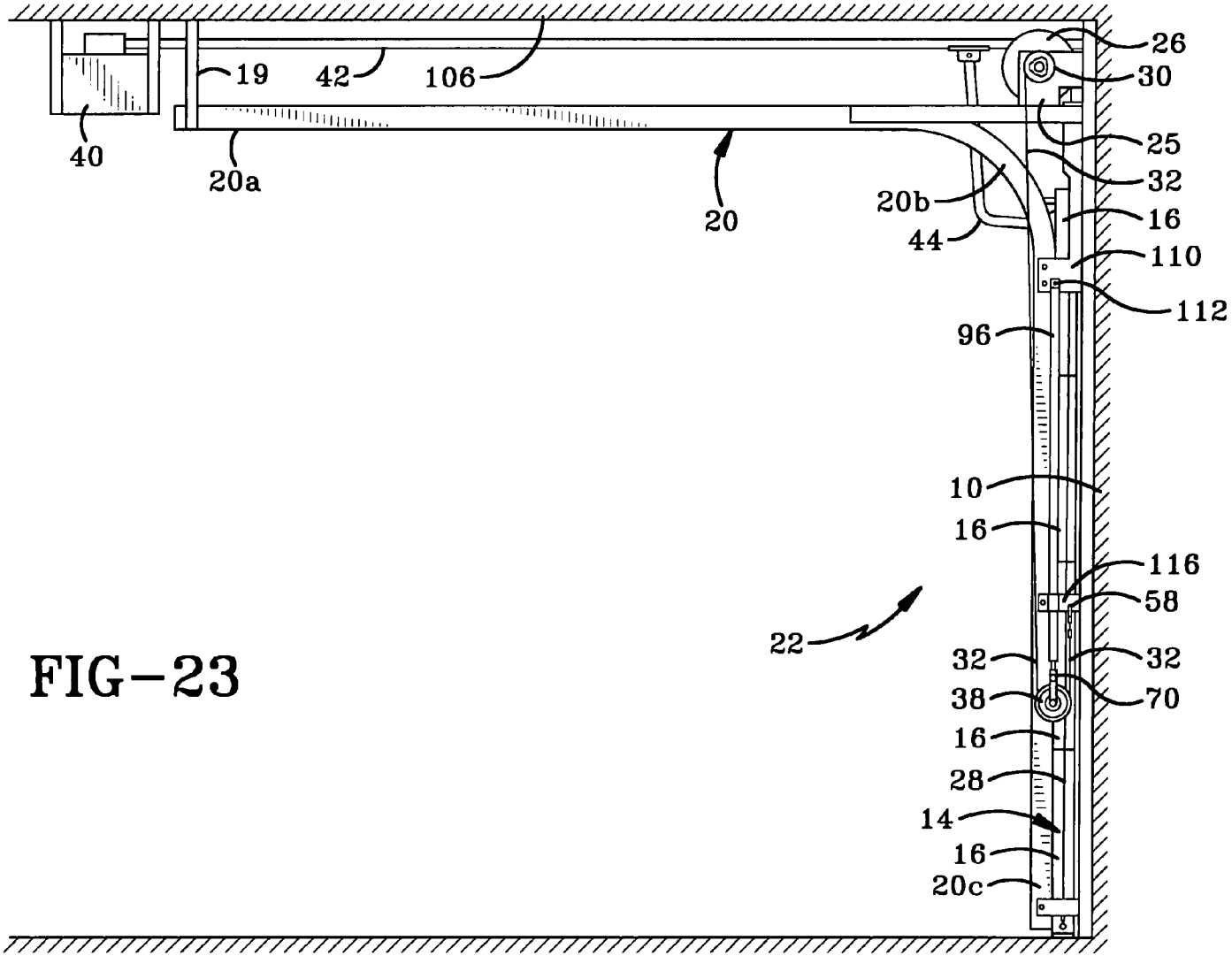
FIG. 23 is a side view of the garage door and operating mechanism shown in FIG. 22, with the door in the closed position.
Figure 24:
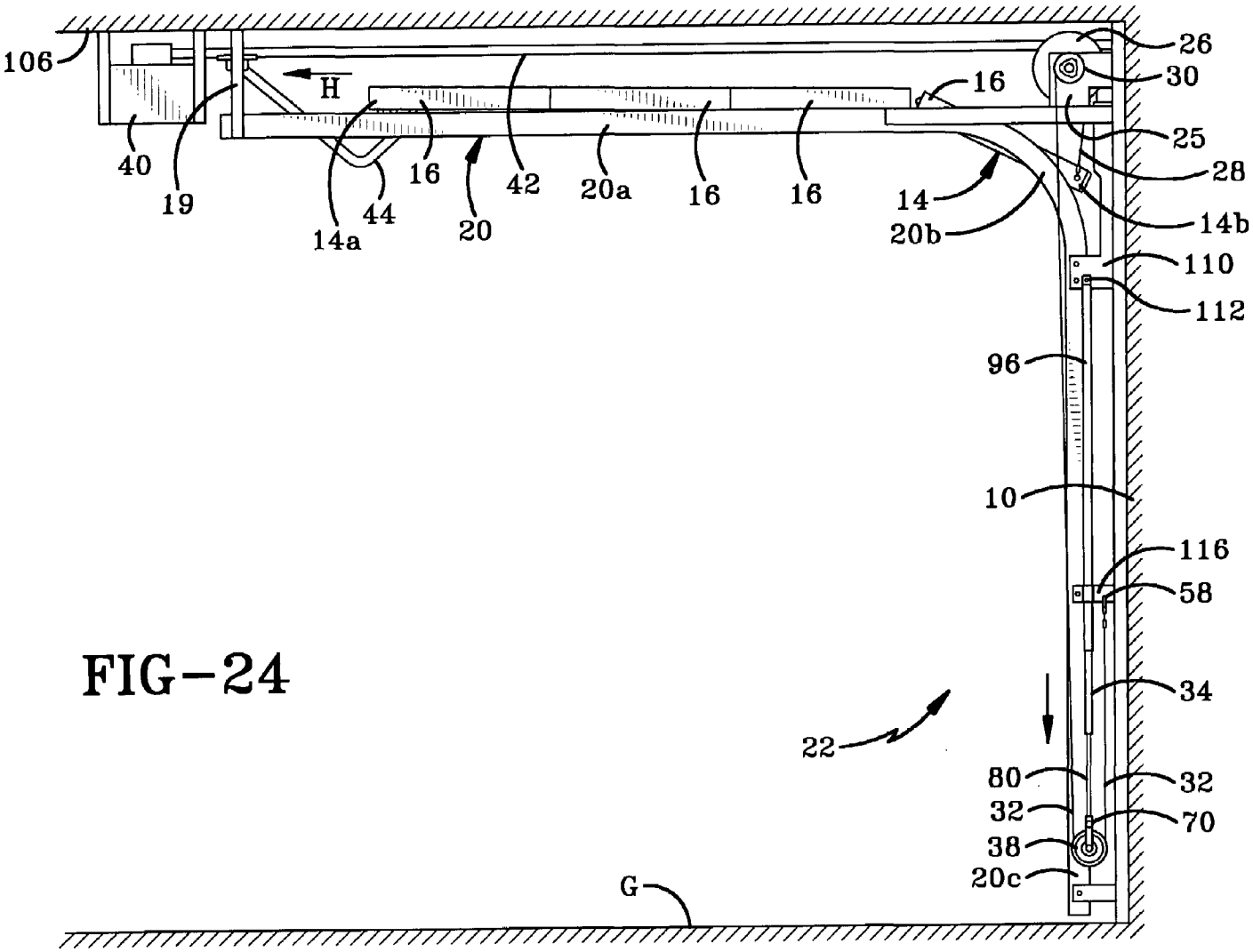
FIG. 24 is a side view of the garage door and operating mechanism with the door moving from a closed to an open position.

Referring to FIGS. 22–24, the first and second gas struts 34, 36 of door operating mechanism 22 may also be mounted adjacent the sides of door opening 12 instead of being mounted substantially parallel to the ceiling 106. In this arrangement, shaft 24, side drums 26 and cable drums 30 are all mounted and operate as previously described. Instead of a guide track being mounted adjacent the sides of the opening 12, the door track 20 may be utilized. (It will of course be understood by one skilled in the art that a separate guide track 21 can be mounted alongside track 20 instead.) The shiv wheel 38 is operatively connected to track 20 by a tab 114 that is welded onto U-shaped bracket 70. Tab 114 is configured to slide up and down track 20 in response to movements by shiv wheel 38. As previously described, shiv wheel 38 is operatively connected to first gas strut 34 which in turn is linked to second gas strut 36. Second gas strut 36 is connected to track support bracket 110 by a suitable connector such as a nut and bolt 112. The tube 96 covers the first and second gas struts 36. Second cable 32 is connected at one end to cable drum 30, wraps around shiv wheel 38 and is connected by a hook 58 to either track 20 or bracket 116. The door 14 opens and closes in essentially the same manner as previously described except that the movement of shiv wheel 38 is substantially vertical instead of substantially horizontal in orientation. It may also be desirable to cover either the shiv wheel 38 and/or piston 34 and piston rod 80 with a protective boot (not shown) to reduce potential damage to the components and to prevent dust and dirt from settling on the same.

The present invention therefore contemplates a method of raising or lowering a door 14 using a door operating mechanism having a pair of side drums 26 operatively connected to the door; at least one pair of first gas struts 34; a pair of cable drums 30 operatively connected to the first gas struts 34; the cable drums 30 and side drums 26 being coaxially mounted on a shaft 24 for simultaneous rotation; whereby the side drums 26 and cable drums 30 are rotatable in a first direction to close the door and in a second direction to open the door; and when the side and cable drums 26, 30 are rotated in the first direction, the first gas struts 34 are charged and when the side and cable drums are rotated in the second direction, the first gas struts 34 are discharged. The door operating mechanism is actuated so as to cause the rotation of the shaft 24 so that the side drums 26 and cable drums 30 rotate in one of the first direction and second direction to respectively open or close the door 14.

It should also be understood that although the door operating system described above discloses the use of a compression type gas strut system, it is also possible to operate the door using an expansion type gas strut system without departing from the spirit of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An operating mechanism for a door comprising:

a pair of side drums operatively connected via a first flexible member to the door; at least one pair of gas struts; and a pair of cable drums operatively connected via a second flexible member to the gas struts; the cable drums and side drums being coaxially mounted for simultaneous rotation;

whereby the side drums and cable drums are rotatable in a first direction to close the door and in a second direction to open the door; and when the side and cable drums are rotated in the first direction, the gas struts are charged and when the side and cable drums are rotated in the second direction, the gas struts are discharged; the second flexible member movably contacting a portion of the gas struts during the charging and discharging.

2. The door operating mechanism as claimed in claim 1, in which the first flexible member is a first cable.

3. The door operating mechanism as claimed in claim 2, in which each first cable has a first end and a second end; and the first end is connected to the side drum and the second end is adapted to be attached to the sides of the door, proximate the door bottom.

4. The door operating mechanism as claimed in claim 2, in which each side drum is helical and includes a plurality of concentric graduations of increasing diameter and the first cable is wound onto or off of the graduations as the side drum rotates.

5. The door operating mechanism as claimed in claim 4, in which each graduation includes a groove and a lip; and the first cable is wound onto and off of the grooves of the graduations.

6. The door operating mechanism as claimed in claim 2, in which the second flexible member is a second cable, the second cable being wound onto or off of the cable drum as the cable drum rotates.

7. The door operating mechanism as claimed in claim 6, wherein the first cable is wound onto the side drum when the second cable is unwound from the cable drum and wherein the first cable is unwound from the side drum when the second cable is wound onto the cable drum.

8. The door operating mechanism as claimed in claim 6, in which the cable drums and side drums are mounted on a single shaft and the cable drums are mounted proximate the ends of the shaft and the side drums are mounted inwardly of the cable drums.

9. The door operating mechanism as claimed in claim 6, further comprising a pair of shiv wheels, each shiv wheel being operatively connected to one of the gas struts, each shiv wheel being configured to receive the respective second cable therearound;

a pair of spaced apart guide tracks; and a pair of brackets, each bracket operatively attaching one of the shiv wheels to one of the guide tracks, whereby the brackets and shiv wheel move along the guide tracks toward or away from the cable drum as the second cable is wound respectively onto and off of the cable drum.

10. The door operating mechanism as claimed in claim 9, in which the guide tracks are mounted substantially parallel to the ceiling of the building in which the door is installed.

11. The door operating mechanism as claimed in claim 9, in which the guide tracks are mounted on either side of the door opening.

12. The door operating mechanism as claimed in claim 9, in which the second cable has a first end which is connected to the cable drum and a second end which is connected to the guide track.

13. The door operating mechanism as claimed in claim 9, further comprising:

a connector;

a hole formed in the shiv wheel; and a vertically aligned slot formed in the bracket, whereby the shiv wheel is connected to the bracket by the connector being received through the vertically aligned slot and the hole and the connector is able to partially slide up and down within the vertically aligned slot as the shiv wheel moves toward or away from the cable drum.

14. The door operating mechanism as claimed in claim 9, in which the gas strut includes a cylinder and a piston rod and the shiv wheel is connected to the piston rod.

15. The door operating mechanism as claimed in claim 14, in which the gas strut is connected to the piston rod by an U-shaped bracket, whereby the movement of the shiv wheel toward the cable drum as the door closes causes the piston rod to be forced into the cylinder, and the movement of the shiv wheel away from the cable drum as the door is opened allows the piston rod to withdraw from the cylinder.

16. The door operating mechanism as claimed in claim 1, further comprising a second gas strut operatively connected to the gas strut.

17. The door operating mechanism as claimed in claim 16, in which the gas strut and second gas strut are at least partially disposed within a cylindrical tube.

18. The door operating mechanism as claimed in claim 17, in which the gas strut and second gas strut are able to at least partially telescope into and out of the tube.

19. The door operating mechanism as claimed in claim 18, in which each of the gas strut and second gas strut include a piston rod and a cylinder;

and the piston rod of the second gas strut is connected to the cylinder of the gas strut.

20. The door operating mechanism as claimed in claim 19, further comprising a connector plate;

at least one connector; and in which the piston rod of the second gas strut is connected to the cylinder of the gas strut by the connector plate and the at least one connector.

21. The door operating mechanism as claimed in claim 20, further comprising:

the first flexible member comprising a pair of first cables, each first cable operatively connecting the door to the respective side drum;

the second flexible member comprising a pair of second cables; each second cable operatively connecting the respective cable drum to the gas strut;

a pair of guide tracks;

a pair of brackets, each bracket being adapted to slide along the respective guide track;

a pair of shiv wheels, each shiv wheel being attached to its respective bracket and each shiv wheel being configured to receive the respective second cable therearound; and in which the shiv wheels and brackets are moved along the guide tracks toward or away from the cable drums as the second cables are wound respectively onto and off of the cable drums.

22. The door operating mechanism as claimed in claim 21, in which the combined stroke of the gas strut and second gas strut is in the range of 15 to 30 inches.

23. A door operating mechanism for opening and closing a sliding door; the mechanism comprising:

a shaft adapted to be mounted proximate an opening in a wall;

a pair of side drums mounted proximate opposing free ends of said shaft;

a pair of cable drums, each cable drum being mounted between one of said side drums and the corresponding free end of the shaft;

a pair of first cables, each of said first cables connected at one end to one of said side drums and being adapted to be connected to the bottom of on side of the door; each of said first cables being windable onto and off of said corresponding side drum;

a pair of guide tracks;

a pair of shiv wheels, each of said shiv wheels being mounted for reciprocal movement along one of said guide tracks;

a pair of second cables, each of said second cables secured at one end to one of said cable drums and at the other end to one of said guide tracks, and in which each of said second cables is wound at least partially around one of said shiv wheels at least one pair of gas struts, each of said gas struts being operationally connected to one of said shiv wheels; in which rotational movement in the shaft causes the first cables to be wound either onto or off of the side drums and simultaneously causes the second cables to be wound either onto or off of the cable drums, and further causes motion in said shiv wheels thereby either charging or discharging the gas struts.

24. The door operating mechanism of claim 23, in which the side drums are helical and include a plurality of concentric graduations of increasing diameter and the respective first cables are each wound onto or off of the graduations.

25. The door operating mechanism of claim 24, further comprising a second gas strut, the second gas strut being operatively linked to the gas strut.

26. The door operating mechanism of claim 25, in which each gas strut and second gas strut are contained within a tube and the gas strut and second gas strut telescope at least partially in and out of the tube in response to movements by the respective shiv wheel.

27. The door operating mechanism of claim 26, in which the gas strut and second gas strut have a combined stroke in the range of 15 to 30 inches.

28. The door operating mechanism of claim 27, in which each pair of the gas strut and second gas strut are mounted at an inclined angle relative to the guide track.

29. The door operating mechanism of claim 28, in which each bracket includes a slot that allows for slight vertical movement of the shiv wheel as it moves along the guide track.

30. The door operating mechanism of claim 28, in which the guide tracks are mounted substantially parallel to the ceiling of the building in which the door is installed.

31. The door operating mechanism as claimed in claim 28, in which the guide tracks are mounted on either side of the door opening.

32. A method of raising or lowering a door comprising the steps of:

a) providing a door operating mechanism having;

a pair of side drums operatively connected to the door;

at least one pair of gas struts; and a pair of cable drums operatively connected to the gas struts; the and side drums being coaxially mounted on a shaft for cable drums simultaneous rotation; whereby the side drums and cable drums are rotatable in a first direction to close the door and in a second direction to open the door; and when the side and cable drums are rotated in the first direction, the gas struts are charged and when the side and cable drums are rotated in the second direction, the gas struts are discharged;

b) actuating the door operating mechanism so as to cause the rotation of the shaft so that the side drums and cable drums rotate in one of the first direction and second direction to respectively open or close the door.

* * * * *